US007442479B2

(12) United States Patent
Niimi

(10) Patent No.: US 7,442,479 B2
(45) Date of Patent: Oct. 28, 2008

(54) ELECTROPHOTOGRAPHIC PHOTORECEPTOR, AND IMAGE FORMING APPARATUS AND PROCESS CARTRIDGE USING THE ELECTROPHOTOGRAPHIC PHOTORECEPTOR

(75) Inventor: Tatsuya Niimi, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 468 days.

(21) Appl. No.: 11/166,382

(22) Filed: Jun. 27, 2005

(65) Prior Publication Data

US 2006/0008719 A1 Jan. 12, 2006

(30) Foreign Application Priority Data

Jul. 8, 2004 (JP) ..... 2004-201300

(51) Int. Cl.
*G03G 15/02* (2006.01)

(52) U.S. Cl. ..... 430/59.1; 430/59.2; 430/60; 430/64; 430/66; 430/67; 399/159

(58) Field of Classification Search ..... 430/59.1, 430/59.2, 60, 64, 66, 67; 399/159
See application file for complete search history.

(56) References Cited

U.S. PATENT DOCUMENTS

| | | | | |
|---|---|---|---|---|
| 4,999,268 | A * | 3/1991 | Ojima et al. | 430/58.8 |
| 5,871,876 | A | 2/1999 | Ikuno et al. | |
| 6,087,055 | A * | 7/2000 | Niimi | 430/58.7 |
| 6,174,636 | B1 * | 1/2001 | Fuller et al. | 430/58.7 |
| 6,558,863 | B2 | 5/2003 | Rokutanzono et al. | |
| 2002/0127487 | A1 * | 9/2002 | Shimada | 430/59.2 |
| 2004/0033428 | A1 | 2/2004 | Niimi | |
| 2004/0053149 | A1 | 3/2004 | Toda et al. | |
| 2004/0234875 | A1 | 11/2004 | Toda et al. | |
| 2005/0069797 | A1 | 3/2005 | Niimi et al. | |

FOREIGN PATENT DOCUMENTS

| | | |
|---|---|---|
| JP | 58-95351 | 6/1983 |
| JP | 59-93453 | 5/1984 |
| JP | 4-170552 | 6/1992 |
| JP | 5-80572 | 4/1993 |

(Continued)

OTHER PUBLICATIONS

Machine translation of JP 06-019174.*
Machine translation of JP 05-080572.*
U.S. Appl. No. 09/566,958, filed May 8, 2000, Tatsuya Niimi, et al.
U.S. Appl. No. 10/974,814, filed Oct. 28, 2004, Nozomu Tamoto, et al.
U.S. Appl. No. 11/474,258, filed Jun. 26, 2006, Niimi.
U.S. Appl. No. 11/611,179, filed Dec. 15, 2006, Niimi et al.
U.S. Appl. No. 11/749,292, filed May 16, 2007, Inaba, et al.
U.S. Appl. No. 11/625,873, filed Jan. 23, 2007, Niimi.
U.S. Appl. No. 11/855,553, filed Sep. 14, 2007, Inaba, et al.

*Primary Examiner*—Mark A Chapman
(74) *Attorney, Agent, or Firm*—Oblon, Spivak, McClelland, Maier & Neustadt, P.C.

(57) ABSTRACT

A photoreceptor including at least an electroconductive substrate, and a charge blocking layer, a moiré preventing layer, and a photosensitive layer, which are located overlying the electroconductive substrate in this order, wherein the photosensitive layer includes an azo pigment having a fluorenone skeleton. The photosensitive layer is preferably prepared by coating a coating liquid including a dispersion which is prepared by dispersing the azo pigment in a solvent to an extent such that the average particle diameter of the azo pigment is not greater than 0.3 μm and the standard deviation of the particle diameter is not greater than 0.2 μm, followed by filtering with a filter having an effective pore diameter not greater than 5 μm. An image forming apparatus and a process cartridge including the photoreceptor.

26 Claims, 8 Drawing Sheets

FOREIGN PATENT DOCUMENTS

| | | |
|---|---|---|
| JP | 6-19174 | 1/1994 |
| JP | 6-208238 | 7/1994 |
| JP | 6-222600 | 8/1994 |
| JP | 8-184979 | 7/1996 |
| JP | 9-43886 | 2/1997 |
| JP | 9-190005 | 7/1997 |
| JP | 9-288367 | 11/1997 |

* cited by examiner

ELECTROPHOTOGRAPHIC PHOTORECEPTOR, AND IMAGE FORMING APPARATUS AND PROCESS CARTRIDGE USING THE ELECTROPHOTOGRAPHIC PHOTORECEPTOR

BACKGROUND OF THE INVENTION

1. Field of the Invention

The present invention relates to an electrophotographic photoreceptor, and more particularly to an electrophotographic photoreceptor having at least a charge blocking layer, a moiré preventing layer and a photosensitive layer including an azo pigment. In addition, the present invention also relates to an image forming apparatus and a process cartridge using the photoreceptor.

2. Discussion of the Background

Recently, development of information processing systems utilizing electrophotography is remarkable. In particular, optical printers in which information converted to digital signals is recorded using light have been dramatically improved in print qualities and reliability. This digital recording technique is applied not only to printers but also to copiers, and so-called digital copiers have been developed and used. Copiers utilizing both the conventional analogue recording technique and this digital recording technique have various information processing functions, and therefore it is expected that demand for such copiers will be escalating. In addition, with popularization and improvement of personal computers, the performance of digital color printers which can produce documents including color images has been rapidly improved and broadly used.

Such digital image forming apparatus are required to be improved in functions year by year. Specifically digital image forming apparatus are required not only to have high durability and high stability but also to produce high quality images. On the other hand, in order to produce color images at a high speed, tandem image forming apparatus which include a plurality of image forming units each including image forming devices such as a photoreceptor, a charger, an image irradiator, an image developer, a cleaner and a quencher have been mainly used as the color image forming apparatus. In such tandem image forming apparatus, yellow, magenta, cyan and black image forming units are typically provided side by side, and four color images concurrently formed in the respective image forming units are overlaid on an intermediate transfer medium or a receiving sheet. Thus, a color image can be formed at a high speed. In such tandem image forming apparatus, the image forming devices used therefor are required to be small in size to avoid jumboization of the image forming apparatus. In particular, it is essential that the photoreceptor has a small diameter. However, a photoreceptor which has a smaller diameter but has a shorter life cannot be used. Namely, it is a problem to be solved how to develop a photoreceptor having a small diameter while having a long life.

The life of a photoreceptor mainly depends on two factors, i.e., electrostatic fatigue of the photoreceptor and abrasion of the surface portion thereof. These are problems to be solved of organic photoreceptors, which are mainly used now for electrophotographic image forming apparatus. The former problem (electrostatic fatigue) is that when a photoreceptor is repeatedly subjected to image forming operations such as charging and light irradiating, the electric potentials (potentials of lighted portions and non-lighted portions) formed on the photoreceptor change. In the case of organic photoreceptors, the potential of non-lighted portions typically decreases while the potential of lighted portions (i.e., residual potential) increases after repeated use. The latter problem is that the uppermost layer of a photoreceptor is mechanically abraded after repeated use by members contacting the photoreceptor such as cleaners. If the uppermost layer is thinned due to abrasion, the strength of electric field formed on the photosensitive layer increases, resulting in acceleration of the electrostatic fatigue, and thereby the life of the photoreceptor is further shortened. In addition, when the surface of the photoreceptor is scratched by the contacting members, undesired images (such as streak images) are formed, resulting in shortening of the life of the photoreceptor. Therefore, these problems have to be solved at the same time, to develop a photoreceptor having a long life.

Recently, electrophotographic image forming apparatus can produce images at a high speed. Therefore, the image forming apparatus have also been used for printing fields. In order that electrophotographic image forming apparatus are used for printing fields, color images with high resolution higher than 600 dpi (dots per inch) have to be stably produced. In addition, electrophotographic image forming apparatus have the following advantages over printing machines:

(1) an original image can be directly reproduced at a high speed without making a plate; and (2) a large number of copies of an original image can be reproduced while a different information image is added to a part of each copy.

Therefore, the image forming apparatus (systems) are required to have good stability, namely the apparatus is required to stably produce high quality images without producing abnormal images.

As mentioned above, long life and good stability are the important requisites for electrophotographic image forming apparatus. Among the image forming devices included in such electrophotographic image forming apparatus, the photoreceptor is the key device. As a result of studies of the electrostatic properties of photoreceptors and abrasion of the surface of photoreceptors, several technologies have been established.

For example, in order to improve electrostatic properties, charge generation materials having a high photo-carrier generating efficiency have been developed; and charge transport materials having large mobility have been developed. By using a combination of such a charge generation material and a charge transport material, a photoreceptor capable of obtaining large gain and making speedy response in a photodecaying process can be provided. Therefore, image forming apparatus using such a photoreceptor for an image forming apparatus have the following advantages:

(1) the potential (i.e., non-lighted potential) of the charged photoreceptor can be decreased;

(2) the quantity of light used for optical writing can be decreased;

(3) the developing bias can be decreased;

(4) the transfer bias can be decreased; and (5) the quenching process can be eliminated.

Thus, the designing flexibility of the image forming apparatus can be increased. When these factors are minimized, the hazards for the photoreceptor can be eliminated, and thereby the designing flexibility of the photoreceptor can also be increased.

The usage of the photoreceptors used for high speed digital full color image forming apparatus is greatly different from that for analog image forming apparatus and monochrome image forming apparatus. For example, various optical writing methods are used in the full color image forming apparatus. In such full color image forming apparatus, abnormal images are typically produced due to the photoreceptor used.

Causes of abnormal images are broadly classified into the following two types. Firstly, abnormal images are caused by scratches formed on the surface of a photoreceptor. Secondly, abnormal images are formed when the photoreceptor used has electrostatic fatigue. In the first case, formation of abnormal images can be prevented to a considerable extent by improving the surface of the photoreceptor (for example, forming a protective layer as an uppermost layer) or improving the contacting members such as cleaners. In the second case, abnormal images (typically, background development) are caused by deterioration of the photoreceptor itself. Among the abnormal images, background development of images produced by a reverse (nega-posi) development method is a big problem now.

Specific examples of the cause for background development are as follows:

(1) soils and defects of the electroconductive substrate used;
(2) dielectric breakdown of the photosensitive layer;
(3) injection of carriers (charges) from the substrate;
(4) increase of dark decay of the photoreceptor; and
(5) carriers thermally generated by the photoreceptor without irradiation of light to the photoreceptor (hereinafter referred to as hot carriers).

Among these causes, the soils and defects of the electroconductive substrate used can be removed before forming the photosensitive layer thereon, and therefore it is not avoidable. Therefore, in order to prevent occurrence of background development, it is important to improve the electric strength of the photoreceptor so that carrier injection from the substrate is prevented and electrostatic fatigue of the photoreceptor is decreased.

From this point of view, techniques such that an undercoat layer or an intermediate layer is formed between an electroconductive substrate and a photosensitive layer have been proposed. For example, published unexamined Japanese patent application No. (hereinafter referred to as JP-A) 47-6341 discloses an intermediate layer including a nitrocellulose, and JP-A 60-66258 discloses an intermediate layer including a nylon resin. In addition, JP-A 52-10138 discloses an intermediate layer including a maleic acid based resin, and JP-A 58-105155 discloses an intermediate layer including a polyvinyl alcohol resin.

However, these intermediate layers are a resin layer and have a high electric resistance. Therefore, the residual potential of the photoreceptors increases, resulting in decrease of image density when images are formed by a nega-posi developing method. In addition, such intermediate layers exhibit ionic conduction caused by impurities included therein, and therefore the electric resistance thereof increases particularly under low temperature and low humidity conditions, resulting in increase of the residual potential. Therefore, the intermediate layer has to be thinned, and thereby a problem in that the charge properties and charge retainability of the photoreceptor deteriorate after repeated use occurs.

In attempting to solve this problem (i.e., in attempting to control the resistance of an intermediate layer), techniques in that an electroconductive material is included in an intermediate layer have been proposed. For example, JP-A 51-65942 discloses an intermediate layer in which carbon or chalcogen materials is dispersed in a crosslinked resin. JP-A 52-82238 discloses an intermediate layer which is crosslinked using an isocyanate crosslinking agent upon application of heat thereto and which includes a quaternary ammonium salt. JP-A 55-113045 discloses a resinous intermediate layer including a resistance controlling agent. JP-A 58-93062 discloses a resinous intermediate layer including an organic metal compound. However, the photoreceptors including such resinous intermediate layers have a drawback in that images having moiré fringes are produced when the photoreceptors are used for image forming apparatus using coherent light such as laser light for image writing.

In attempting to solve the resistance and moiré fringe problems, intermediate layers including a filler have been proposed. For example, JP-A 58-58556 discloses a resinous intermediate layer including aluminum oxide or tin oxide. JP-A 60-111255 discloses a resinous intermediate layer including a particulate electroconductive material. JP-A 59-17557 discloses an intermediate layer including magnetite. JP-A 60-32054 discloses a resinous intermediate layer including titanium oxide and tin oxide. JP-As 64-68762, 64-68763, 64-73352, 64-73353, 01-118848 and 01-118849 have disclosed resinous intermediate layers including a powder such as borides, nitrides, fluorides and oxides. In these resinous intermediate layers including a filler, the content of the filler in the intermediate layer has to be increased (i.e., the content of the resin has to be decreased) so that the intermediate layer has the desired electric properties. Therefore, the adhesion of the intermediate layer to the electroconductive substrate deteriorates, and thereby a problem in that the intermediate layer is separated from the electroconductive substrate tends to occur. Particularly, when the substrate is a flexible belt, the problem occurs more frequently.

In attempting to solve the problem, formation of a layered intermediate layer has been proposed. The proposed layered intermediate layers are broadly classified into two types, which have structures as illustrated in FIGS. 1 and 2. The first type of the intermediate layers, which is illustrated in FIG. 1, includes an electroconductive substrate 1, and a resin layer 2 including a filler, a resin layer 3 including no filler, and a photosensitive layer 4, which are overlaid in this order. The second type of the intermediate layers, which is illustrated in FIG. 2, includes an electroconductive substrate 1, and a resin layer 3 including no filler, a resin layer 2 including a filler and a photosensitive layer 4 which are overlaid in this order.

Specifically, in the first type intermediate layer, the electroconductive layer 2 includes a filler having a low electric resistance and is formed on the electroconductive substrate 1. In addition, the resin layer 3 is formed thereon. The intermediate layers of this type have been disclosed in JP-As 58-95351, 59-93453, 04-170552, 06-208238, 06-222600, 08-184979, 09-43886, 09-190005 and 09-288367.

In the intermediate layers of this type, the electroconductive layer 2 serves as an electrode. Therefore the intermediate layer is electrically the same as the resinous intermediate layer of the photoreceptor mentioned above, and thereby the above-mentioned electrostatic problem of the photoreceptor having a resinous intermediate layer cannot be solved. Since the electroconductive layer includes a filler, occurrence of moiré fringes can be prevented because the light beam for image writing scatter. When such a photoreceptor is charged, charges having a polarity opposite to that of the charges formed on the surface of the photoreceptor reach the interface between the electroconductive layer 2 and the resinous layer 3. However, when the electroconductive layer 2 has a relatively high resistance, charges are not well injected from the electroconductive substrate 1, and the resistance of the layer 2 increases after long repeated use, thereby increasing the residual potential of the photoreceptor. In addition, in order to avoid the problem caused by defects of the electroconductive substrate 1, the layer 2 has to have a thickness not less than about 10 μm. In this case, the residual potential increasing problem remarkably occurs.

JP-As 05-100461, 05-210260 and 07-271072 have disclosed photoreceptors including an electroconductive layer, and an intermediate layer and a photosensitive layer including a titanylphthalocyanine crystal, which are overlaid in this order. However, the crystal form and the primary particle diameter of the titanyl phthalocyanine crystal are not controlled. Therefore, occurrence of the background development problem due to the hot carriers cannot be prevented.

In the second type intermediate layer, a positive hole blocking layer is formed on the electroconductive substrate, and a resin layer including a filler having a low resistance or an electroconductive filler is formed on the positive hole blocking layer. These intermediate layers have been disclosed in JP-As 05-80572 and 06-19174. The photoreceptors of this type hardly cause the background development problem because the intermediate layer has a positive hole blocking function. In addition, since a filler-including layer is present thereon, residual potential hardly increases. Specifically, injection of positive holes from the electroconductive substrate 1 to the photosensitive layer 4 can be avoided, and thereby the background development problem in a nega-posi development method is hardly caused. In addition, since a charge blocking layer is formed as a lower layer, the degree of increase of residual potential of the photoreceptor after long repeated use is lower than in the case where the charge blocking layer is formed as an upper layer.

However, the background development is caused not only by charges injected from the electroconductive substrate to the photosensitive layer but also by carriers thermally generated in the photosensitive layer. If a proper charge generation material is not used for the charge generation layer and the conditions of the particles of the charge generation material are not properly controlled, occurrence of the background development problem cannot be prevented.

Because of these reasons, a need exists for an electrophotographic photoreceptor which can stably produce high quality images even after long repeated use with hardly causing the background development problem and the dielectric breakdown problem.

SUMMARY OF THE INVENTION

Accordingly, an object of the present invention is to provide an electrophotographic photoreceptor which can stably produce high quality images after long repeated use with hardly causing the background development problem and the dielectric breakdown problem even when a contact charger or a short-range charger is used for charging the photoreceptor.

Another object of the present invention is to provide an image forming apparatus and a process cartridge, which can produce high quality images even after long repeated use with hardly causing the background development problem and the low density image problem even when a nega-posi development method is used.

Briefly these objects and other objects of the present invention as hereinafter will become more readily apparent can be attained by a photoreceptor including at least an electroconductive substrate, and a charge blocking layer, a moiré preventing layer, and a photosensitive layer, which are located overlying the electroconductive substrate in this order, wherein the photosensitive layer includes an azo pigment having the following formula (I):

(I)

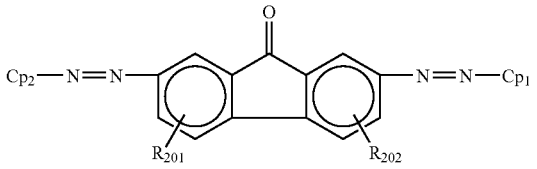

wherein $R_{201}$ and $R_{202}$ independently represent a hydrogen atom, a halogen atom, an alkyl group, an alkoxyl group, or a cyano group; and $Cp_1$ and $Cp_2$ independently represent a residual group of a coupler, which has the following formula (II):

(II)

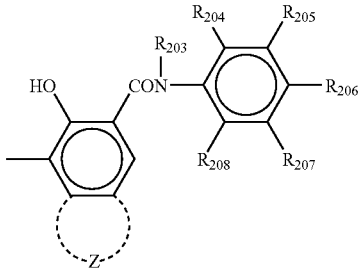

wherein $R_{203}$ represents a hydrogen atom, an alkyl group (such as a methyl group and an ethyl group), or an aryl group (such as a phenyl group); $R_{204}$, $R_{205}$, $R_{206}$, $R_{207}$ and $R_{208}$ independently represent a hydrogen atom, a nitro group, a cyano group, a halogen atom (such as a fluorine atom, a chlorine atom, a bromine atom and an iodine atom), an alkyl group (such as a trifluoromethyl group, a methyl group and an ethyl group), an alkoxyl group (such as a methoxy group and an ethoxy group), a dialkylamino group or a hydroxyl group; and Z represents an atomic group needed for constituting a substituted or unsubstituted aromatic carbon ring or a substituted or unsubstituted aromatic heterocyclic ring.

The group Cp1 is preferably different from the group Cp2. The photosensitive layer preferably includes a charge generation layer and a charge transport layer.

The photosensitive layer or the charge generation layer is preferably prepared by coating a coating liquid including a dispersion which is prepared by dispersing the azo pigment in a solvent to an extent such that the average particle diameter of the azo pigment is not greater than 0.3 μm and the standard deviation of the particle diameter is not greater than 0.2 μm, followed by filtering with a filter having an effective pore diameter not greater than 5 μm.

It is preferable that the charge blocking layer includes an insulating material (preferably a polyamide resin) and has a thickness not greater than 2.0 μm.

The moiré preventing layer preferably includes an inorganic pigment and a binder resin, wherein the volume ratio of the inorganic pigment to the binder resin is preferably from 1/1 to 3/1. The binder resin is preferably a thermosetting resin, and more preferably a mixture of an alkyd resin and a melamine resin, wherein the weight ratio (alkyd/melamine) thereof is preferably from 5/5 to 8/2. Titanium oxide is preferably used as the inorganic pigment. More preferably two kinds of titanium oxides (T1 and T2) are used as the inorganic pigment, wherein the titanium oxides satisfy the following relationship:

$$0.2<(D2/D1)\leqq 0.5$$

wherein D1 and D2 represents the average particle diameters of the two kinds of titanium oxides (T1 and T2), respectively. The average particle diameter (D2) of the titanium oxide (T2) is preferably greater than 0.05 μm and less than 0.2 μm. The weight ratio (T2/(T1+T2)) of the second titanium oxide (T2) to the total weight of the titanium oxides is preferably from 0.2 to 0.8.

The photoreceptor preferably has a protective layer as the outermost layer. The protective layer preferably includes an inorganic pigment (such as metal oxides) having a resistivity not less than $10^{10}$ Ω·cm. More preferably, the protective layer includes a pigment selected from the group consisting of alumina, titanium oxide and silica which have a resistivity not less than $10^{10}$ Ω·cm. Even more preferably, the pigment is α-alumina. The protective layer preferably includes a charge transport polymer, or a crosslinked binder resin which preferably includes a charge transport moiety.

As another aspect of the present invention, an image forming apparatus is provided which includes one or more image forming units each including a charging device, a light irradiating device, a developing device, a transferring device and the photoreceptor mentioned above.

The charging device preferably includes a contact charger or a short-range charger which charges the photoreceptor preferably with a gap not greater than 100 μm. The charging device preferably applies a DC voltage overlapped with an AC voltage to the photoreceptor.

It is preferable that the image forming apparatus includes a process cartridge which is detachably attached to the image forming apparatus and in which the photoreceptor and at least one of the charging device, the light irradiating device, the developing device and a cleaning device are unitized.

As yet another aspect of the present invention, a process cartridge is provided which includes the photoreceptor mentioned above and at least one of a charging device, a light irradiating device, a developing device and a cleaning device and which can be detachably attached to an image forming apparatus.

These and other objects, features and advantages of the present invention will become apparent upon consideration of the following description of the preferred embodiments of the present invention taken in conjunction with the accompanying drawings.

DETAILED DESCRIPTION OF THE INVENTION

Figure 1:
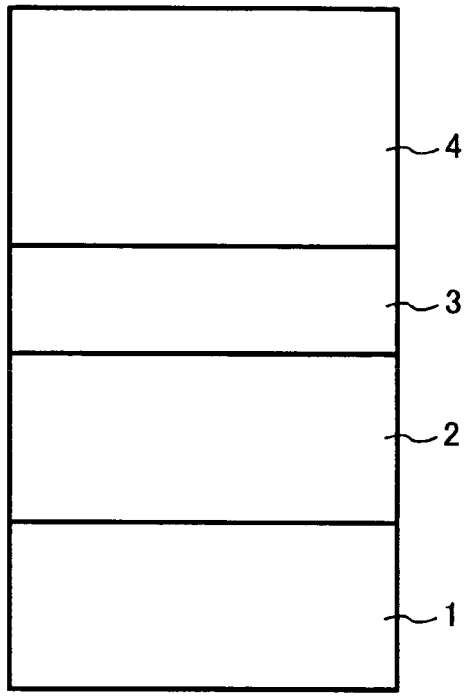
FIG. 1 BACKGROUND ART
FIGS. 1 and 2 are schematic views illustrating the cross-sections of conventional photoreceptors having a layered intermediate layer.
Figure 2:
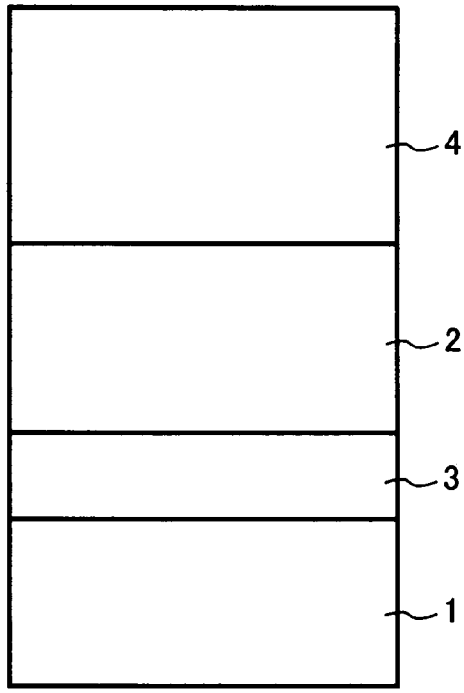
FIG. 2 BACKGROUND ART

At first the photoreceptor of the present invention will be explained in detail.

The photoreceptor of the present invention includes at least an electroconductive substrate, and a charge blocking layer, a moiré preventing layer, and a photosensitive layer, which are located overlying the electroconductive substrate in this order, wherein the photosensitive layer includes an azo pigment having the following formula (I):

(I)

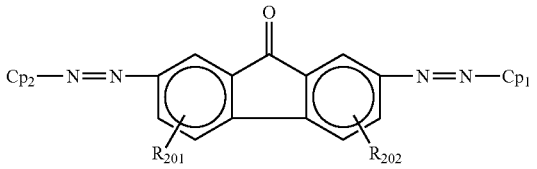

wherein $R_{201}$ and $R_{202}$ independently represent a hydrogen atom, a halogen atom, an alkyl group, an alkoxyl group, or a cyano group; and $Cp_1$ and $Cp_2$ independently represent a residual group of a coupler, which has the following formula (II):

(II)

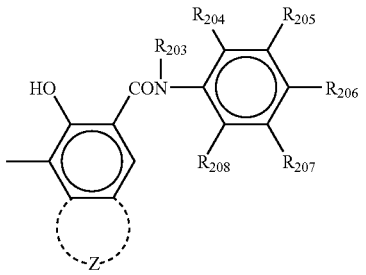

wherein $R_{203}$ represents a hydrogen atom, an alkyl group (such as a methyl group and an ethyl group), or an aryl group (such as a phenyl group); $R_{204}$, $R_{205}$, $R_{206}$, $R_{207}$ and $R_{208}$ independently represent a hydrogen atom, a nitro group, a cyano group, a halogen atom (such as a fluorine atom, a chlorine atom, a bromine atom and an iodine atom), an alkyl group (such as a trifluoromethyl group, a methyl group and an ethyl group), an alkoxyl group (such as a methoxy group and an ethoxy group), a dialkylamino group or a hydroxyl group; and Z represents an atomic group needed for constituting a substituted or unsubstituted aromatic carbon ring or a substituted or unsubstituted aromatic heterocyclic ring.

Azo pigments having such a specific formula are described in published examined Japanese patent application No. (hereinafter referred to as JP-B) 60-29109 and Japanese patent No. 3026645. By using such azo pigments, a photoreceptor having high photosensitivity and good charging properties after long repeated use can be provided. However, the azo pigments have been used for photoreceptors of image forming apparatus which form images using an analog light source, and are hardly used for photoreceptors of image forming apparatus which form images using a digital light source.

As a result of the present inventor's investigation, it is found that photoreceptors using such azo pigments cause the background development problem when images having a resolution not less than 600 dpi or 1200 dpi are produced for a long period of time, resulting in expiration of the life of the photoreceptors. Thus, the original properties of the azo pigments cannot be fully utilized for conventional photoreceptors. As a result of the present inventor's analysis of the problem, it is found that by properly controlling the particle diameter of the azo pigments in the photosensitive layer, occurrence of the problem can be prevented.

On the other hand, a photoreceptor having an intermediate layer in which a charge blocking layer and a moiré preventing layer are overlaid in this order is described in JP-A 05-80572. However, when a high photosensitive layer is used for the photoreceptor, occurrence of the background development problem cannot be fully prevented because of generation of hot carriers in the photosensitive layer. Specifically, when a charge generation material having high photo-carrier generation efficiency (such as the azo pigments mentioned above) is used for the photosensitive layer, the problem is serious.

Namely, both the above-mentioned technologies are incomplete. Specifically, even when a photosensitive layer including such an azo pigment as mentioned above is formed on an intermediate layer including a charge blocking layer and a moiré preventing layer, the background development problem and the dielectric breakdown problem cannot be fully avoided although the photoreceptor has high sensitivity and electrostatic stability.

As a result of the present inventor's investigation, it is found that by controlling the particle diameter of the azo pigment used in the photosensitive layer so as to be small, specifically, not greater than 0.25 μm, by the methods mentioned below, the object of the present invention can be attained.

At first, the method for synthesizing the azo pigments having formula (I) will be explained.

The synthesis method is described in JP-B 60-29109 and Japanese patent No. 3026645. However, in order to prepare an azo pigment having a relatively small particle diameter, the following method is preferably used. Specifically, the method is such that coarse particles having a particle diameter greater than 0.25 μm are removed from the dispersion of the azo pigment.

In the present application, the average particle diameter means the volume average particle diameter, and can be determined by a centrifugal automatic particle diameter analyzer, CAPA-700 from Horiba Ltd. The volume average particle diameter means the cumulative 50% particle diameter (i.e., the Median diameter). However, when using this method, a problem in that a small amount of coarse particles cannot be detected occurs. Therefore, it is preferable to directly observe the dispersion including an azo pigment with an electron microscope, to determine the average particle diameter of the pigment.

In addition, as a result of the present inventor's analysis of minute coating defects formed in a layer prepared using an azo pigment dispersion, the following knowledge can be acquired. The presence of coarse particles in a dispersion can be detected by a particle diameter measuring instrument if the concentration of coarse particles is on the order of few percent or more. However, when the concentration is not greater than 1%, the presence of coarse particles cannot be detected by such an instrument. Therefore, even when it is confirmed that the average particle diameter of the pigment in a dispersion falls in the preferable range, a problem in that the resultant charge generation layer has minute coating defects can occur.

Figure 3:
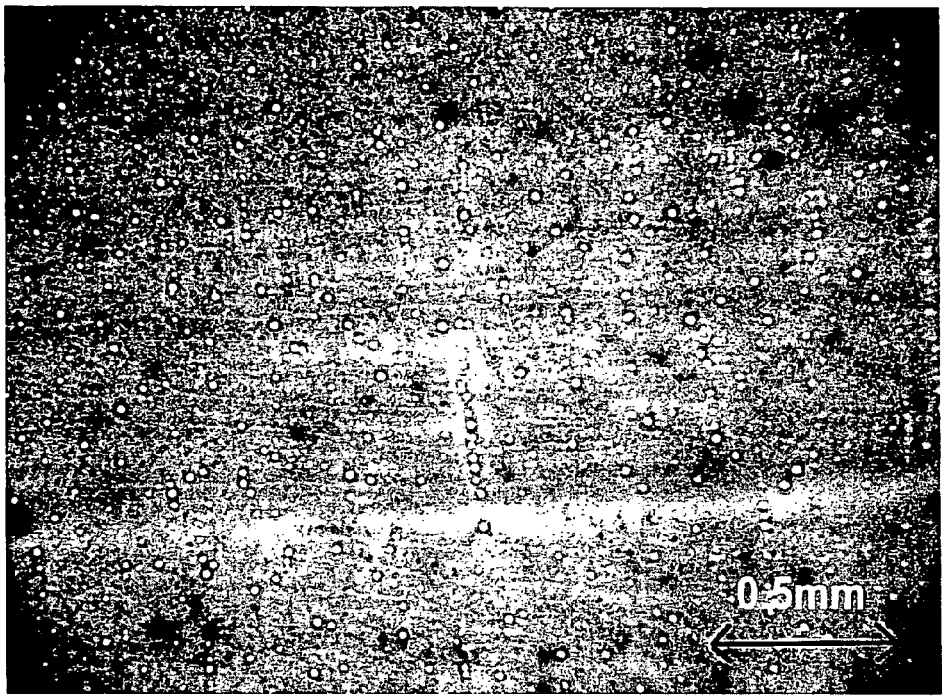
FIGS. 3 and 4 are photographs showing the dispersion state of a pigment in different dispersions.
Figure 4:
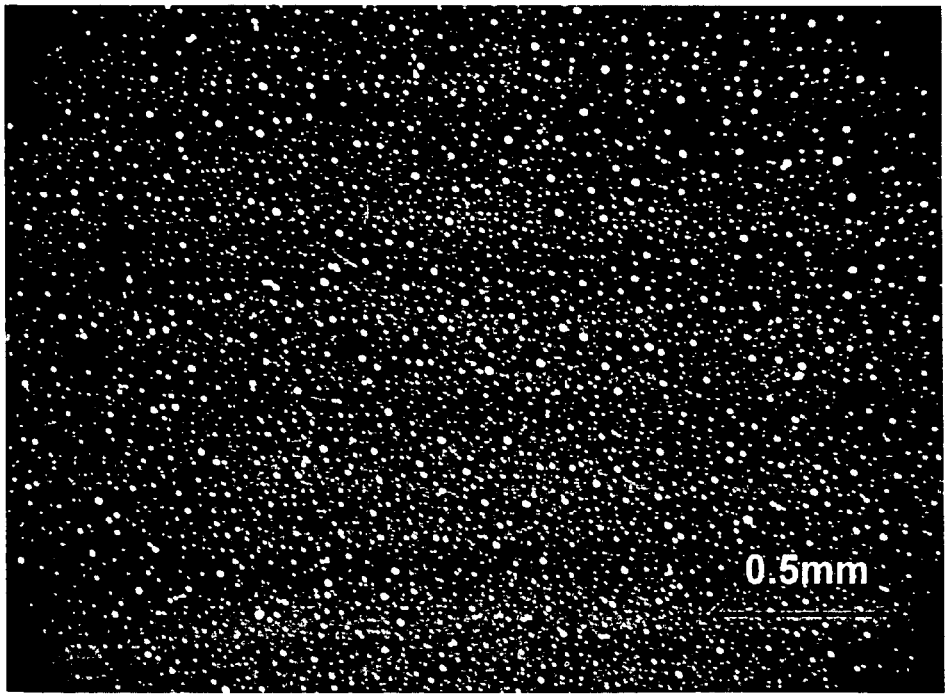

FIGS. 3 and 4 are photographs showing the dispersion state of a pigment in different dispersions A and B which are prepared by the same method except that the dispersion time is changed. The dispersion time for the dispersion A is shorter than that for the dispersion B. As can be understood from FIG. 3, coarse particles are present in the dispersion A. Coarse particles are observed as black spots in FIG. 3.

Figure 5:
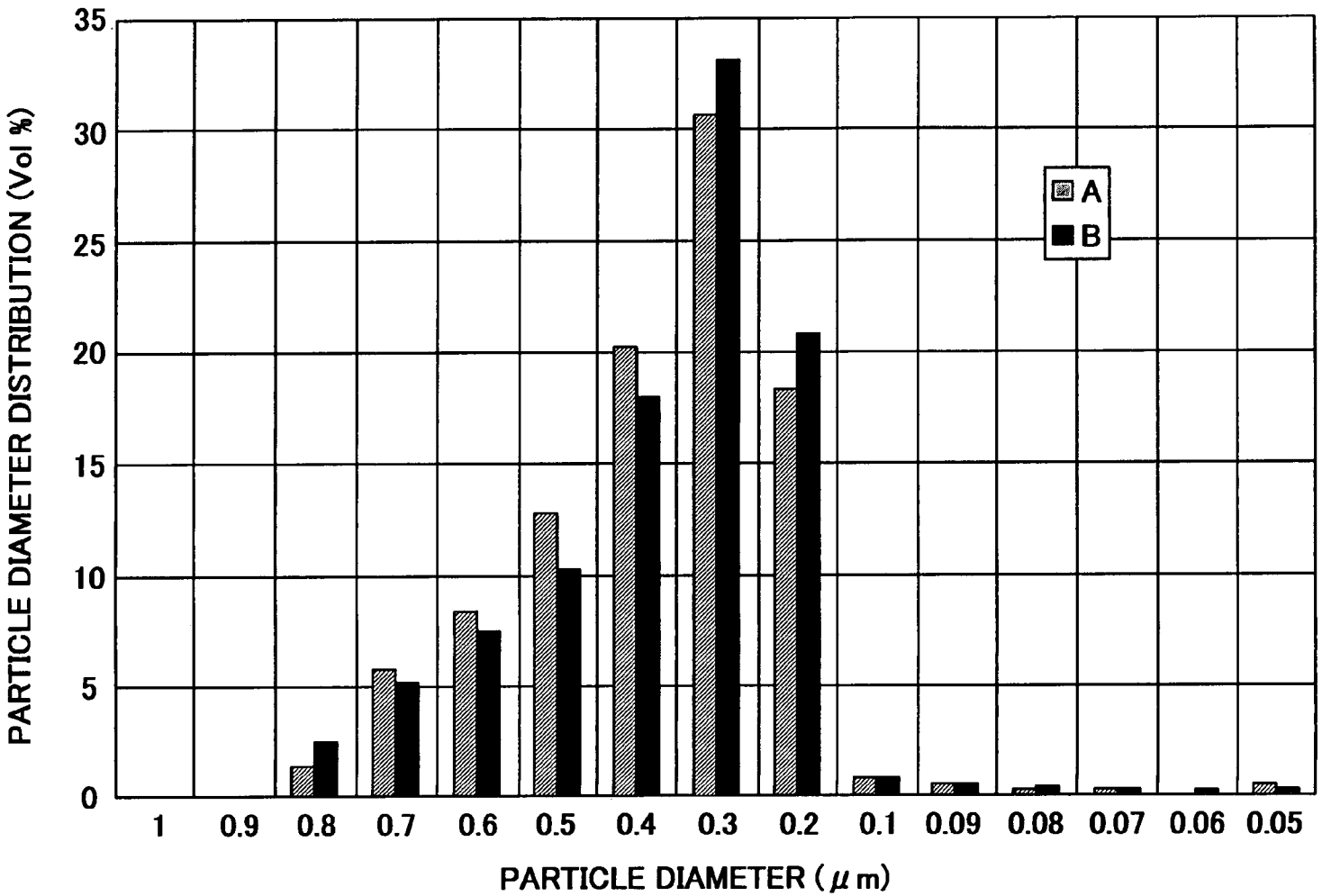
FIG. 5 is a graph showing the particle diameter distributions of the pigment in the dispersions.

The particle diameter distributions of the dispersions A and B, which are measured with a centrifugal automatic particle diameter analyzer, CAPA-700 from Horiba Ltd., are illustrated in FIG. 5. In FIG. 5, characters A and B represent the particle diameter distributions of the dispersions A and B, respectively. As can be understood from the graph, the particle diameter distributions are almost the same. The average particle diameters of the dispersions A and B are 0.29 and 0.28 μm, respectively, which are the same when considering the measurement error. Thus, whether or not coarse particles are present in a dispersion cannot be determined by such a method in which the average particle diameter of the particles in the dispersion is measured by such a particle diameter measuring instrument. As mentioned above, the presence of coarse particles in a dispersion can be detected only by the method in which the dispersion is directly observed using a microscope.

Next, a method for removing coarse particles from a dispersion will be explained.

A dispersion including one or more of the above-mentioned azo pigments is prepared by dispersing the pigment, optionally together with a binder resin, in a solvent using a ball mill, an attritor, a sand mill, a bead mill, an ultrasonic dispersing machine or the like. In this case, it is preferable that a proper resin is chosen to impart good electrostatic properties to the resultant photoreceptor and a proper solvent is chosen while considering its abilities to wet and disperse the azo pigment used.

Specifically, the method is that an azo pigment is dispersed while applying a shear force thereto an extent such that the pigment does not cause a crystal change, and the dispersion is then filtered using a filter with a proper pore size. By using this method, a small amount of coarse particles (which cannot be visually observed or detected by a particle diameter measuring instrument) can be removed from the dispersion. In addition, the particle diameter distribution of the particles in the dispersion can be properly controlled. Specifically, it is preferable to use a filter with an effective pore diameter not greater than 5 μm, and more preferably not greater than 3 μm. By using such a filter, a dispersion in which an azo pigment is dispersed while having an average particle diameter not greater than 0.25 μm (preferably not greater than 0.20 μm) can be prepared. By using this dispersion for the photoreceptor of the present invention, the effects of the present invention can be fully produced.

When the dispersion to be filtered has a large average particle diameter or a wide particle diameter distribution, a problem in that great loss is produced or the filtering operation itself cannot be performed due to clogging of the pores with coarse particles occurs in the filtering process. Therefore, it is preferable that the dispersing operation is performed such that particles in the dispersion to be filtered have a particle diameter distribution such that the average particle diameter is not greater than 0.3 μm and the standard deviation of the particle diameter is not greater than 0.2 μm. When the average particle diameter is too large, great loss is produced. When the standard deviation is too large, the filtering operation takes a long time.

The azo pigments for use in the photoreceptor of the present invention have a strong inter-molecular hydrogen bond, by which a high photosensitivity can be imparted to the photoreceptor. Therefore, there are strong interaction among the azo pigment particles dispersed in a dispersion. Consequently, there is a strong possibility that the dispersed azo pigment particles are agglomerated, for example, when the dispersion is diluted. Even in this case, by filtering the diluted dispersion using such a filter as mentioned above, the agglomerated particles can be removed. Since such a dispersion has a thixotropic state, and therefore particles having a particle diameter smaller than the effective pore diameter of the filter used can be removed in the filtering process. In addition, it is possible to change a liquid having a structural viscosity to a Newtonian fluid by performing filtering. By thus removing coarse particles in the azo pigment dispersion used for the photosensitive layer, the effects of the present invention can be further increased.

It is preferable that a proper filter is chosen depending on the size of coarse particles to be removed. As a result of the present inventors' investigation, it is found that coarse particles having a particle diameter not less than 3 μm affect the image qualities of images with a resolution of 600 dpi (600 dots/25.4 mm), and it is preferable to use a filter with a pore diameter not greater than 5 μm, and more preferably not greater than 3 μm, to remove coarse particles having a particle diameter not less than 3 μm. Filters with too small a pore diameter filter out particles which can be used for the dispersion as well as coarse particles to be removed. In addition, such filters cause problems in that filtering takes a long time, the clogging problem occurs, and an excessive stress is applied to the pump used. Therefore, a filter with a proper pore diameter is preferably used. Needless to say, the filter preferably has good resistance to the solvent used for the dispersion.

Then the photoreceptor of the present invention will be explained referring to drawings.

Figure 6:
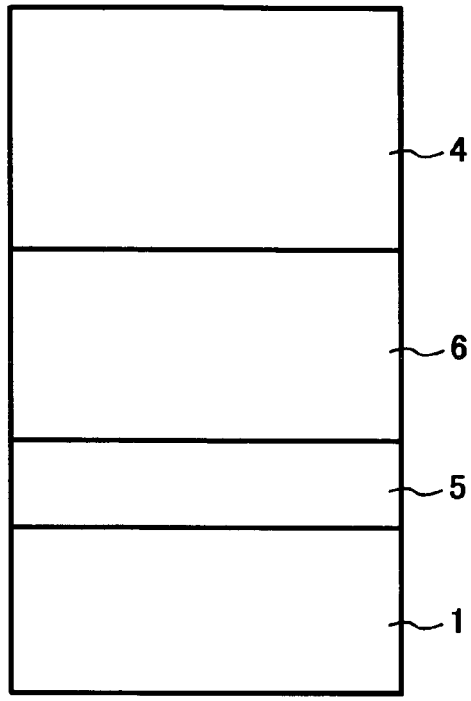
FIGS. 6 to 8 are schematic views illustrating the cross-sections of embodiments of the photoreceptor of the present invention.

FIG. 6 is a cross section of an example of the photoreceptor of the present invention. The photoreceptor has an electroconductive substrate 1, a charge blocking layer 5, a moiré preventing layer 6 and a photosensitive layer 4 including an azo pigment which has formula (I) and which has the specific average particle diameter mentioned above, wherein the layers 5, 6 and 4 are overlaid on the electroconductive substrate 1 in this order.

Figure 7:
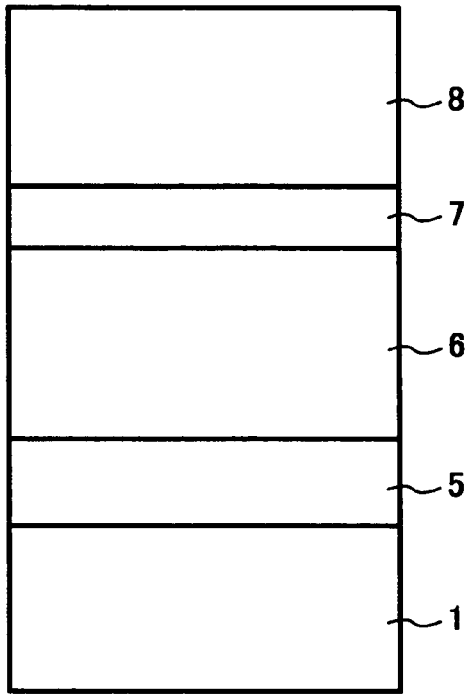

FIG. 7 is a cross section of another example of the photoreceptor of the present invention. The photoreceptor has an electroconductive substrate 1, a charge blocking layer 5, a moiré preventing layer 6, a charge generation layer 7 including an azo pigment which has formula (I) and which has the specific average particle diameter mentioned above, and a charge transport layer 8 including a charge transport material as a main component, wherein the layers 5, 6, 7 and 8 are overlaid on the electroconductive substrate 1 in this order.

Figure 8:
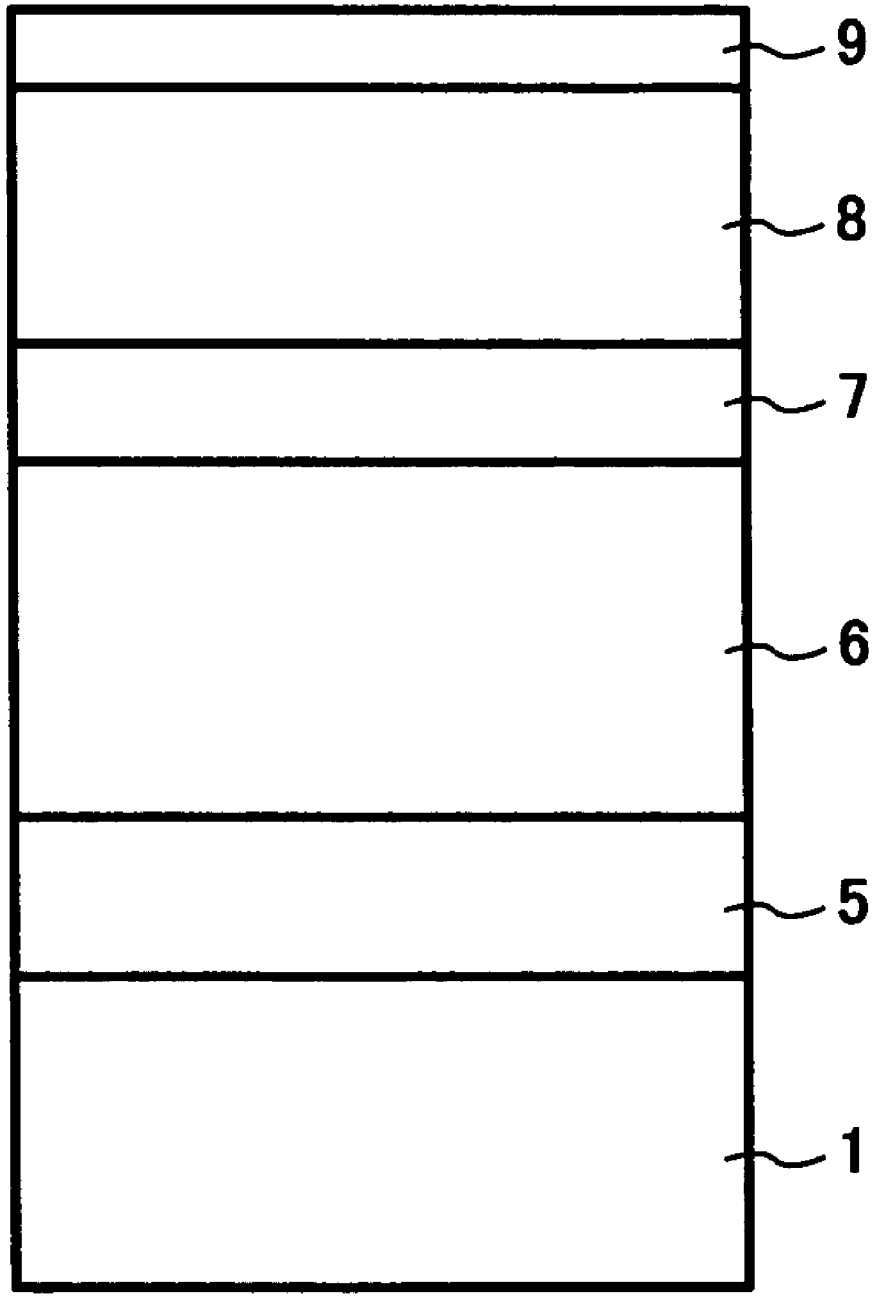

FIG. 8 is a cross section of yet another example of the photoreceptor of the present invention. The photoreceptor has an electroconductive substrate 1, a charge blocking layer 5, a moiré preventing layer 6, a charge generation layer 7 including an azo pigment which has formula (I) and which has the specific average particle diameter mentioned above, a charge transport layer 8 including a charge transport material as a main component, and a protective layer 9, wherein the layers 5, 6, 7, 8 and 9 are overlaid on the electroconductive substrate 1 in this order.

Suitable materials for use as the electroconductive substrate 1 include materials having a volume resistivity not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is formed by deposition or sputtering. In addition, a plate of a metal such as aluminum, aluminum alloys, nickel and stainless steel can be used. A metal cylinder can also be used as the substrate 1, which is prepared by tubing a metal such as aluminum, aluminum alloys, nickel and stainless steel by a method such as impact ironing or direct ironing, and then treating the surface of the tube by cutting, super finishing, polishing and the like treatments. Further, endless belts of a metal such as nickel, stainless steel and the like can also be used as the substrate 1.

Furthermore, substrates, in which a coating liquid including a binder resin and an electroconductive powder is coated on the supports mentioned above, can be used as the substrate 1. Specific examples of such an electroconductive powder include carbon black, acetylene black, powders of metals such as aluminum, nickel, iron, nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins.

Such an electroconductive layer can be formed by coating a coating liquid in which an electroconductive powder and a binder resin are dispersed or dissolved in a proper solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins (such as TEFLON), with an electroconductive material, can also be used as the substrate 1.

Then the charge blocking layer 5 will be explained.

The function of the charge blocking layer 5 is to prevent the charges, which are induced in the electrode (i.e., the electroconductive substrate 1) and have a polarity opposite to that of the voltage applied to the photoreceptor by a charger, from being injected into the photosensitive layer. Specifically, when negative charging is performed, the charge blocking layer 5 prevents injection of positive holes into the photosensitive layer. In contrast, when positive charging is performed, the charge blocking layer 5 prevents injection of electrons to the photosensitive layer. Specific examples of the charge blocking layer include the following layers:

(1) a layer prepared by anodic oxidation, such as aluminum oxide layers;

(2) an insulating layer of an inorganic material such as SiO;

(3) a layer made of a network of a glassy metal oxide as disclosed in JP-A 03-191361;

(4) a layer made of polyphosphazene as disclosed in JP-A 03-141363;

(5) a layer made of a reaction product of aminosilane as disclosed in JP-A 03-101737;

(6) a layer made of an insulating resin; and (7) a crosslinked resin layer.

Among these layers, an insulating resin layer and a crosslinked resin layer, which can be formed by a wet coating method, are preferably used. Since the moiré preventing layer and the photosensitive layer are typically formed on the charge blocking layer by a wet coating method, the charge blocking layer preferably has good resistance to the solvents included in the coating liquids of the moiré preventing layer and the photosensitive layer.

Suitable resins for use in the charge blocking layer include thermoplastic resins such as polyamide resins, polyester resins, and vinyl chloride/vinyl acetate copolymers; and thermosetting resins which can be prepared by thermally polymerizing a compound having a plurality of active hydrogen atoms (such as hydrogen atoms of —OH, —$NH_2$, and —NH) with a compound having a plurality of isocyanate groups and/or a compound having a plurality of epoxy groups.

Specific examples of the compounds having a plurality of active hydrogen atoms include polyvinyl butyral, phenoxy resins, phenolic resins, polyamide resins, phenolic resins, polyamide resins, polyester resins, polyethylene glycol resins, polypropylene glycol resins, polybutylene glycol resins, and acrylic resins (such as hydroxyethyl methacrylate resins). Specific examples of the compounds having a plurality of isocyanate groups include tolylene diisocyanate, hexamethylene diisocyanate, diphenylmethane diisocyanate, and prepolymers thereof. Specific examples of the compounds having a plurality of epoxy groups include bisphenol A based epoxy resins, etc.

Among these resins, polyamide resins are preferably used in view of film formability, environmental stability and resistance to solvents.

In addition, thermosetting resins prepared by thermally polymerizing an oil-free alkyd resin with an amino resin such as a butylated melamine resin; and photo-crosslinking resins prepared by reacting an unsaturated resin, such as unsaturated polyurethane resins and unsaturated polyester resins, with a photo-polymerization initiator such as thioxanthone compounds and methylbenzyl formate, can also be used as the binder resin.

In addition, electroconductive polymers having a rectification property, and layers including a resin or a compound having an electron accepting or donating property which is determined depending on the polarity of the charges formed on the surface of the photoreceptor can also be used as the binder resin.

The charge blocking layer 5 preferably has a thickness not less than 0.1 μm and less than 2.0 μm, and more preferably from 0.3 μm to 1.0 μm. When the charge blocking layer is too thick, the residual potential of the photoreceptor increases after imagewise light irradiation is repeatedly performed particularly under low temperature and low humidity conditions. In contrast, the charge blocking layer is too thin, the charge blocking effect is hardly produced. The charge blocking layer 5 can include one or more materials such as crosslinking agents, solvents, additives and crosslinking promoters. The charge blocking layer 5 can be prepared by coating a coating liquid by a coating method such as blade coating, dip coating, spray coating, bead coating and nozzle coating, followed by drying and crosslinking using heat or light.

Then the moiré preventing layer 6 will be explained.

The function of the moiré preventing layer 6 is to prevent occurrence of moiré in images due to interference of light, which is caused when coherent light (such as laser light) is used for optical writing. Namely, the moiré preventing layer scatters the light used for optical writing. In order to carry out this function, the layer preferably includes a material having a high refractive index. The moiré preventing layer typically includes a binder resin and an inorganic pigment. Suitable inorganic pigments include white inorganic pigments. Specific examples of the white inorganic pigments include titanium oxide, calcium fluoride, calcium oxide, silica, magnesium oxide and aluminum oxide. Among these pigments, titanium oxide is preferably used because of having high hiding power.

As can be understood from FIGS. 6 to 8, injection of charges from the substrate 1 is blocked by the charge blocking layer 5 and therefore the moiré preventing layer 6 preferably has an ability to transport charges having the same polarity as that of the charges formed on the surface of the photoreceptor, to prevent increase of residual potential. For example, in a case of a negative charge type photoreceptor, the moiré preventing layer 6 preferably has an electron conducting ability. Therefore it is preferable to use an electroconductive inorganic pigment or a conductive inorganic pigment for the moiré preventing layer 6. Alternatively, an electroconductive material (such as acceptors) may be added to the moiré preventing layer 6.

Specific examples of the binder resin for use in the moiré preventing layer 6 include the resins mentioned above for use in the charge blocking layer 5. Since the photosensitive layer 4 is formed on the moiré preventing layer 6 by coating a coating liquid, the binder resin preferably has a good resistance to the solvent included in the photosensitive layer coating liquid. Among the resins, thermosetting resins, and more preferably mixtures of alkyd and melamine resins, are preferably used as the binder resin of the moiré preventing layer 6. The mixing ratio of an alkyd resin to a melamine resin is an important factor influencing the structure and properties of the moiré preventing layer 6, and the weight ratio thereof (i.e., the alkyd/melamine ratio) is preferably from 5/5 to 8/2. When the content of melamine resin is too high, the coated film is shrunk in the thermosetting process, and thereby coating defects are formed in the resultant film. In addition, the residual potential increasing problem occurs. In contrast, when the content of alkyd resin is too high, the electric resistance of the layer seriously decreases, and thereby the resultant images have background fouling, although the residual potential of the photoreceptor is reduced.

The mixing ratio of the inorganic pigment to the binder resin in the moiré preventing layer 6 is also an important factor, and the volume ratio thereof is preferably from 1/1 to 3/1. When the ratio is too low (i.e., the content of the inorganic pigment is too low), not only the moiré preventing effect deteriorates but also the residual potential increases after repeated use. In contrast, when the ratio is too high, the film formability of the layer deteriorates, resulting in deterioration of surface conditions of the resultant layer. In addition, a problem in that the upper layer (e.g., the photosensitive layer) cannot form a good film because the coating liquid penetrates into the moiré preventing layer occurs. This problem is fatal to the photoreceptor having a layered photosensitive layer including a thin charge generation layer as a lower layer because such a thin charge generation layer cannot be formed on such a moiré preventing layer. In addition, when the ratio is too large, a problem in that the surface of the inorganic pigment cannot be covered with the binder resin. In this case, the charge generation material is directly contacted with the inorganic pigment and thereby the possibility that carriers are thermally produced is increased, resulting in occurrence of the background development problem.

By using two kinds of titanium oxides having different average particle diameters for the moiré preventing layer, the substrate 1 is effectively hidden by the moiré preventing layer and thereby occurrence of moiré fringes can be well prevented and formation of pinholes in the layer can also be prevented. In this regard, the average particle diameters (D1 and D2) of the two kinds of titanium oxides (T1 and T2) preferably satisfy the following relationship:

$$0.2 < D2/D1 \leqq 0.5.$$

When the ratio D2/D1 is too low, the surface of the titanium oxide becomes more active, thereby seriously deteriorating stability of the electrostatic properties of the resultant photoreceptor. In contrast, when the ratio is too high, the electroconductive substrate 1 cannot be well hidden by the moiré preventing layer, resulting in deterioration of the moiré preventing effect and production of abnormal images such as moiré fringes. In this regard, the average particle diameter of a pigment means the average particle diameter of the pigment in a dispersion prepared by dispersing the pigment in water while applying a strong shear force thereto.

Further, the average particle diameter (D2) of the titanium oxide (T2) having a smaller average particle diameter is also an important factor, and is preferably greater than 0.05 μm and less than 0.20 μm. When D2 is too small, hiding power of the moiré preventing layer deteriorates. Therefore, moiré fringes tend to be caused. In contrast, when D2 is too large, the filling factor of the titanium oxide in the layer decreases, and thereby background development preventing effect cannot be well produced.

The mixing ratio of the two kinds of titanium oxides T1 and T2 in the moiré preventing layer 6 is also an important factor, and is preferably determined such that the following relationship is satisfied:

$$0.2 \leqq T2/(T1+T2) \leqq 0.8,$$

wherein T1 represents the weight of the titanium oxide having a larger average particle diameter, and T2 represents the weight of the titanium oxide having a smaller average particle diameter.

When the mixing ratio is too low, the filling factor of the titanium oxide in the layer decreases, and thereby background development preventing effect cannot be well produced. In contrast, when the mixing ratio is too high, the hiding power of the layer deteriorates, and thereby the moiré preventing effect cannot be well produced.

The moiré preventing layer preferably has a thickness of from 1 to 10 μm, and more preferably from 2 to 5 μm. When the layer is too thin, the moiré preventing effect cannot be well produced. In contrast, when the layer is too thick, the residual potential increasing problem occurs.

The moiré preventing layer is typically prepared as follows. An inorganic pigment is dispersed in a solvent together with a binder resin using a dispersion machine such as ball mills, sand mills, and attritors. In this case, crosslinking agents, other solvents, additives, crosslinking promoters, etc., can be added thereto if desired. The thus prepared coating liquid is coated on the charge blocking layer by a method such as blade coating, dip coating, spray coating, bead coating and nozzle coating, followed by drying and crosslinking using light or heat.

Then the photosensitive layer 4 will be explained.

The photosensitive layer 4 may be a single-layered photosensitive layer including a charge generation material and a charge transport material. However, the photosensitive layer 4 is preferably a multi-layered photosensitive layer including the charge generation layer 7 and the charge transport layer 8 because of having good photosensitivity and good durability.

The charge generation layer 7 includes an azo pigment having formula (I) as a main component.

The charge generation layer 7 is typically prepared by coating a coating liquid, which is prepared by dispersing the azo pigment in a solvent, optionally together with a binder resin, using a ball mill, an attritor, a sand mill or an ultrasonic dispersion machine, followed by drying. Suitable coating methods include dip coating, spray coating, bead coating, nozzle coating, spinner coating and ring coating.

Specific examples of the binder resins, which are optionally included in the charge generation layer coating liquid, include polyamide, polyurethane, epoxy resins, polyketone, polycarbonate, silicone resins, acrylic resins, polyvinyl butyral, polyvinyl formal, polyvinyl ketone, polystyrene, polysulfone, poly-N-vinylcarbazole, polyacrylamide, polyvinyl benzal, polyester, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins.

The content of the binder resin in the charge generation layer is preferably from 0 to 500 parts by weight, and preferably from 10 to 300 parts by weight, per 100 parts by weight of the charge generation material included in the layer.

Specific examples of the solvents for use in the charge generation layer coating liquid include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and the like solvents.

The charge generation layer preferably has a thickness of from 0.01 to 5 μm, and more preferably from 0.1 to 2 μm.

Then the charge transport layer 8 will be explained.

The charge transport layer 8 is typically prepared by coating a coating liquid, which is prepared by dissolving or dispersing a charge transport material in a solvent optionally together with a binder resin, followed by drying. If desired, additives such as plasticizers, leveling agents and antioxidants can be added to the coating liquid.

Charge transport materials are classified into positive-hole transport materials and electron transport materials.

Specific examples of the positive-hole transport materials include known materials such as poly-N-vinyl carbazole and its derivatives, poly-γ-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, and the like.

Specific examples of the electron transport materials include electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, benzoquinone derivatives and the like.

These charge transport materials can be used alone or in combination.

Specific examples of the binder resin for use in the charge transport layer include known thermoplastic resins and thermosetting resins, such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate, phenoxy resins, polycarbonate, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like.

The content of the charge transport material in the charge transport layer is preferably from 20 to 300 parts by weight, and more preferably from 40 to 150 parts by weight, per 100 parts by weight of the binder resin included in the charge transport layer. The thickness of the charge transport layer 8 is preferably from 5 to 100 μm.

Suitable solvents for use in the charge transport layer coating liquid include tetrahydrofuran, dioxane, toluene, dichloromethane, monochlorobenzene, dichloroethane, cyclohexanone, methyl ethyl ketone, acetone and the like solvents. In view of environmental protection, non-halogenated solvents are preferably used. Specifically, cyclic ethers such as tetrahydrofuran, dioxolan and dioxane, aromatic hydrocarbons such as toluene and xylene, and their derivatives are preferably used.

Charge transport polymers, which have both a binder resin function and a charge transport function, can be preferably used for the charge transport layer because the resultant charge transport layer has good abrasion resistance.

Suitable charge transport polymers include known charge transport polymer materials. Among these materials, polycarbonate resins having a triarylamine group in their main chain and/or side chain are preferably used. In particular, charge transport polymers having the following formulae of from (1) to (10) are preferably used:

(1)

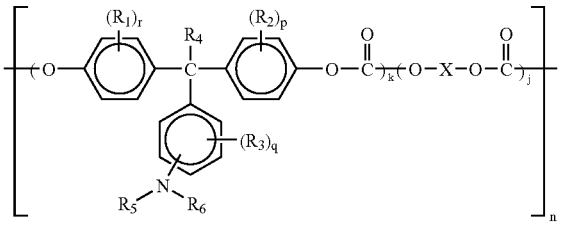

wherein $R_1$, $R_2$ and $R_3$ independently represent a substituted or unsubstituted alkyl group, or a halogen atom; $R_4$ represents a hydrogen atom, or a substituted or unsubstituted alkyl group; $R_5$, and $R_6$ independently represent a substituted or unsubstituted aryl group; r, p and q independently represent 0 or an integer of from 1 to 4; k is a number of from 0.1 to 1.0 and j is a number of from 0 to 0.9; n is an integer of from 5 to 5000; and X represents a divalent aliphatic group, a divalent alicyclic group or a divalent group having the following formula:

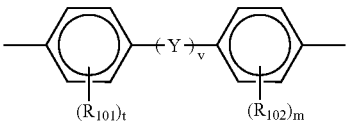

wherein $R_{101}$ and $R_{102}$ independently represent a substituted or unsubstituted alkyl group, a substituted or unsubstituted aryl group, or a halogen atom; t and m represent 0 or an integer of from 1 to 4; v is 0 or 1; and Y represents a linear alkylene group, a branched alkylene group, a cyclic alkylene group, —O—, —S—, —SO—, —$SO_2$—, —CO—, —CO—O-Z-O—CO— (Z represents a divalent aliphatic group), or a group having the following formula:

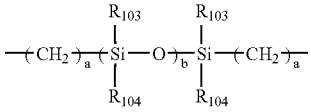

wherein a is an integer of from 1 to 20; b is an integer of from 1 to 2000; and $R_{103}$ and $R_{104}$ independently represent a substituted or unsubstituted alkyl group, or a substituted or unsubstituted aryl group, wherein $R_{101}$, $R_{102}$, $R_{103}$ and $R_{104}$ may be the same or different from the others.

(2)

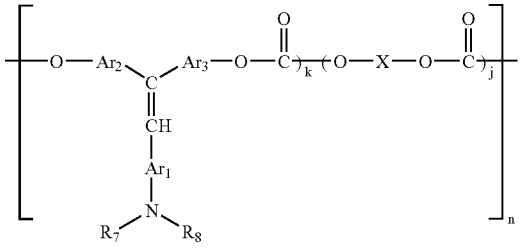

wherein $R_7$ and $R_8$ independently represent a substituted or unsubstituted aryl group; $Ar_1$, $Ar_2$ and $Ar_3$ independently represent an arylene group; and X, k, j and n are defined above in formula (1).

(3)

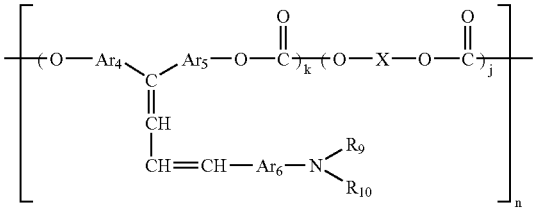

wherein $R_9$ and $R_{10}$ independently represent a substituted or unsubstituted aryl group; $Ar_4$, $Ar_5$ and $Ar_6$ independently represent an arylene group; and X, k, j and n are defined above in formula (1).

(4)

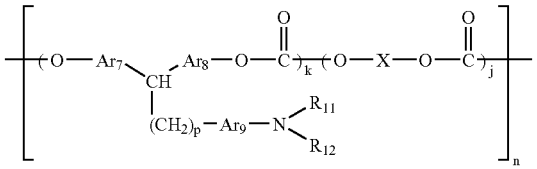

wherein $R_{11}$ and $R_{12}$ independently represent a substituted or unsubstituted aryl group; $Ar_7$, $Ar_8$ and $Ar_9$ independently represent an arylene group; p is an integer of from 1 to 5; and X, k, j and n are defined above in formula (1).

(5)

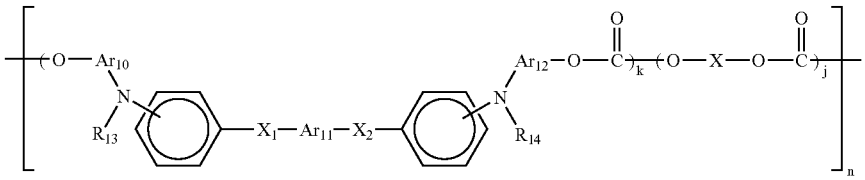

wherein $R_{13}$ and $R_{14}$ independently represent a substituted or unsubstituted aryl group; $Ar_{10}$, $Ar_{11}$, and $Ar_{12}$ independently represent an arylene group; $X_1$ and $X_2$ independently represent a substituted or unsubstituted ethylene group, or a substituted or unsubstituted vinylene group; and X, k, j and n are defined above in formula (1).

(6)

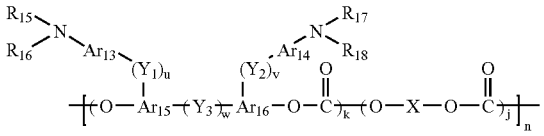

wherein $R_{15}$, $R_{16}$, $R_{17}$ and $R_{18}$ independently represent a substituted or unsubstituted aryl group; $Ar_{13}$, $Ar_{14}$, $Ar_{15}$ and $Ar_{16}$ independently represent an arylene group; $Y_1$, $Y_2$ and $Y_3$ independently represent a substituted or unsubstituted alkylene group, a substituted or unsubstituted cycloalkylene group, a substituted or unsubstituted alkyleneether group, an oxygen atom, a sulfur atom, or a vinylene group; u, v and w independently represent 0 or 1; and X, k, j and n are defined above in formula (1).

(7)

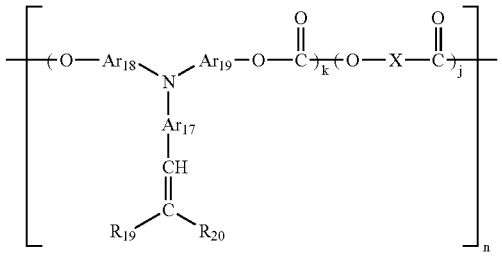

wherein $R_{19}$ and $R_{20}$ independently represent a hydrogen atom, or substituted or unsubstituted aryl group, and $R_{19}$ and $R_{20}$ optionally share bond connectivity to form a ring; $Ar_{17}$, $Ar_{18}$ and $Ar_{19}$ independently represent an arylene group; and X, k, j and n are defined above in formula (1).

(8)

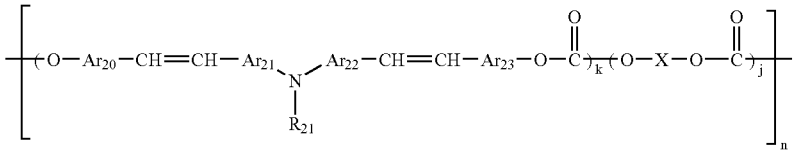

wherein $R_{21}$ represents a substituted or unsubstituted aryl group; $Ar_{20}$, $Ar_{21}$, $Ar_{22}$ and $Ar_{23}$ independently represent an arylene group; and X, k, j and n are defined above in formula (1).

(9)

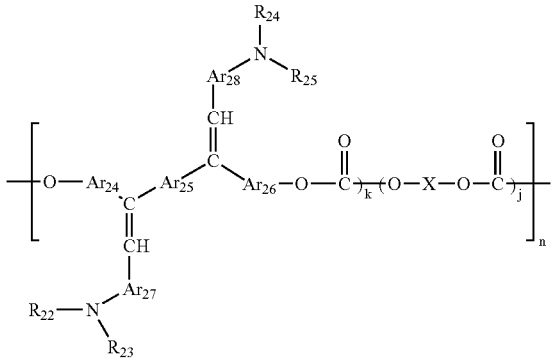

wherein $R_{22}$, $R_{23}$, $R_{24}$ and $R_{25}$ independently represent a substituted or unsubstituted aryl group; $Ar_{24}$, $Ar_{25}$, $Ar_{26}$, $Ar_{27}$ and $Ar_{28}$ independently represent an arylene group; and X, k, j and n are defined above in formula (1).

(10)

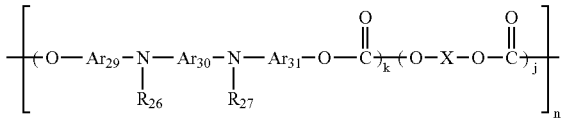

wherein $R_{26}$ and $R_{27}$ independently represent a substituted or unsubstituted aryl group; $Ar_{29}$, $Ar_{30}$ and $Ar_{31}$ independently represent an arylene group; and X, k, j and n are defined above in formula (1).

Formulae (1) to (10) are illustrated in the form of block copolymers, but the polymers are not limited thereto, and may be random copolymers.

In addition, the charge transport layer can also be formed by coating one or more monomers or oligomers, which have an electron donating group, and then subjecting the monomers or oligomers to a crosslinking reaction such that the layer has a two- or three-dimensional structure.

Further, the charge transport layer can be constituted of a layer having a crosslinked structure. The crosslinked structure can be formed, for example, by performing a crosslinking reaction using one or more reactive monomers having a plurality of crosslinkable functional groups in their molecule and using light or heat energy, resulting in formation of three-dimensional network structure. When the charge transport layer has such a structure, the photoreceptor has good abrasion resistance. In this case, it is preferable to use one or more monomers having a charge transportability as the reactive monomers. By using such monomers, the resultant network structure has a charge transport moiety therein, and therefore the layer has good charge transportability. Suitable monomers for use as the monomers having a charge transportability include reactive monomers having a triarylamine structure.

The charge transport layer having such a crosslinked structure reduces its volume when crosslinked. Therefore, when such a charge transport layer is formed while having too large a thickness, a problem in that the layer has a crack occurs. Therefore it is possible to form a layered charge transport layer which includes a lower charge transport layer including a polymer and a low molecular weight charge transport material and an upper charge transport layer including such a crosslinked charge transport layer.

The charge transport layer constituted of a polymer or a crosslinked polymer, which has an electron donating group, has good abrasion resistance. In electrophotographic image forming apparatus, the potential of charges formed on a photoreceptor (i.e., the potential of a non-lighted area) is generally set to be constant. Therefore, the heavier the abrasion loss of the photosensitive layer of the photoreceptor, the larger the intensity of electric field formed on the photoreceptor.

When the intensity of electric field increases, background development occurs in the resultant images. Namely a photoreceptor having good abrasion resistance hardly causes the background development problem. The above-mentioned charge transport layer constituted of a polymer having an electron donating group has good film formability because the layer itself is a polymer. In addition, the charge transport layer has good charge transportability because of including charge transport moieties at a relatively high concentration compared to charge transport layers including a polymer and a low molecular weight charge transport material. Namely, the photoreceptor including a charge transport layer constituted of a charge transport polymer has a high response property.

Known copolymers, block polymers, graft polymers, and star polymers can also be used for the polymers having an electron donating group. In addition, crosslinking polymers including an electron donating group, which have been disclosed in JP-As 03-109406, 2000-206723, and 2001-34001, can also be used for the charge transport layer.

The charge transport layer may include additives such as plasticizers and leveling agents. Specific examples of the plasticizers include known plasticizers such as dibutyl phthalate and dioctyl phthalate. The content of the plasticizer in the charge transport layer is from 0 to 30% by weight based on the binder resin included in the charge transport layer. Specific examples of the leveling agents include silicone oils such as dimethyl silicone oils and methyl phenyl silicone oils, and polymers and oligomers, which include a perfluoroalkyl group in their side chain. The content of the leveling agent in the charge transport layer is from 0 to 1% by weight based on the binder resin included in the charge transport layer.

Hereinbefore, the layered photosensitive layer is explained. However, the photosensitive layer of the photoreceptor of the present invention is not limited to the layered photosensitive layer, and a single-layered photosensitive layer can also be used. In this case, the photosensitive layer 4 includes at least a charge generation material and a binder resin. Suitable materials for use as the binder resin include the materials mentioned above for use as the binder resin in the charge generation layer and the charge transport layer. In addition, a charge transport material is preferably added to the single-layered photosensitive layer so that the resultant photoreceptor has high photosensitivity, high carrier transportability and low residual potential. In this case, a proper charge transport material is chosen from hole transport materials or electron transport materials of the charge transport materials which is determined depending on the charges to be formed on the surface of the photoreceptor. In addition, the charge transport polymers mentioned above can also be preferably used for the single-layered photosensitive layer.

In the photoreceptor of the present invention, a protective layer 9 is optionally formed on the photosensitive layer to protect the photosensitive layer. Recently, computers are used in daily life, and therefore a need exists for a high-speed and small size printer. By forming a protective layer on the photosensitive layer, the resultant photoreceptor has good durability while having a high sensitivity and producing images without abnormal images.

Specific examples of the material for use in the protective layer 9 include ABS resins, ACS resins, olefin-vinyl monomer copolymers, chlorinated polyether, aryl resins, phenolic resins, polyacetal, polyamide, polyamideimide, polyallysulfone, polybutylene, polybutyleneterephthalate, polycarbonate, polyarylate, polyethersulfone, polyethylene, polyethyleneterephthalate, polyimide, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins, etc. Among these resins, polycarbonate and polyarylate are preferably used.

In addition, in order to impart good abrasion resistance to the protective layer, fluorine-containing resins such as polytetrafluoroethylene, and silicone resins can be used therefor. Further, combinations of such resins and an inorganic filler such as titanium oxide, aluminum oxide, tin oxide, zinc oxide, zirconium oxide, magnesium oxide, potassium titanate and silica or an organic filler can also be used therefor. These inorganic fillers may be subjected to a surface-treatment.

In addition, organic and inorganic fillers can be used in the protective layer. Suitable organic fillers include powders of fluorine-containing resins such as polytetrafluoroethylene, silicone resin powders, amorphous carbon powders, etc. Specific examples of the inorganic fillers include powders of metals such as copper, tin, aluminum and indium; metal oxides such as alumina, silica, tin oxide, zinc oxide, titanium oxide, alumina, zirconia, indium oxide, antimony oxide, bismuth oxide, calcium oxide, tin oxide doped with antimony, indium oxide doped with tin; potassium titanate, etc. In view of hardness, the inorganic fillers are preferable. In particular, silica, titanium oxide and alumina are preferable.

The content of the filler in the protective layer is preferably determined depending on the species of the filler used and the application of the resultant photoreceptor, but the content of a filler in the surface portion of the protective layer is preferably not less than 5% by weight, more preferably from 10 to 50% by weight, and even more preferably from 10 to 30% by weight, based on the total weight of the surface portion of the protective layer.

The filler included in the protective layer preferably has a volume average particle diameter of from 0.1 to 2 μm, and more preferably from 0.3 to 1 μm. When the average particle diameter is too small, good abrasion resistance cannot be imparted to the resultant photoreceptor. In contrast, when the average particle diameter is too large, the surface of the resultant protective layer is seriously roughened or a problem such that a protective layer itself cannot be formed occurs.

In the present application, the average particle diameter of a filler means a volume average particle diameter unless otherwise specified, and is measured using an instrument, CAPA-700 manufactured by Horiba Ltd. In this case, the cumulative 50% particle diameter (i.e., the median particle diameter) is defined as the average particle diameter. In addition, it is preferable that the standard deviation of the particle diameter distribution curve of the filler used for the protective layer is not greater than 1 μm. When the standard deviation is too large (i.e., when the filler has too broad particle diameter distribution), the effect of the present invention cannot be produced.

The pH of the filler used for the protective layer coating liquid largely influences on the dispersibility of the filler in the coating liquid and the resolution of the images produced by the resultant photoreceptor. The reasons therefor are as follows. Fillers (in particular, metal oxides) typically include hydrochloric acid therein which is used during the production of the fillers. When the content of hydrochloric acid is large, the resultant photoreceptor tends to produce blurred images. In addition, inclusion of too large an amount of hydrochloric acid causes the dispersibility of the filler to deteriorate.

Another reason therefor is that the charge properties of fillers (in particular, metal oxides) are largely influenced by the pH of the fillers. In general, particles dispersed in a liquid are charged positively or negatively. In this case, ions having a charge opposite to the charge of the particles gather around the particles to neutralize the charge of the particles, resulting in formation of an electric double layer, and thereby the particles are stably dispersed in the liquid. The potential (i.e., zeta potential) of a point around one of the particles decreases (i.e., approaches to zero) as the distance between the point and the particle increases. Namely, a point far apart from the particle is electrically neutral, i.e., the zeta potential thereof is zero. In this case, the higher the zeta potential, the better the dispersion of the particles. When the zeta potential is nearly equal to zero, the particles easily aggregate. The zeta potential of a system largely depends on the pH of the system. When the system has a certain pH, the zeta potential becomes zero. This point is called an isoelectric point. It is preferable to increase the zeta potential by setting the pH of the system to be far apart from the isoelectric point, in order to stabilize the dispersion of the system.

It is preferable for the protective layer to include a filler having a pH of 5 or more at the isoelectric point, in order to prevent formation of blurred images. In other words, fillers having a highly basic property can be preferably used in the photoreceptor of the present invention because the effect of the present invention can be heightened. Fillers having a highly basic property have a high zeta potential (i.e., the fillers are stably dispersed) when the system for which the fillers are used is acidic.

In this application, the pH of a filler means the pH of the filler at the isoelectric point, which is determined by the zeta potential of the filler. Zeta potential can be measured by a laser beam potential meter manufactured by Ootsuka Electric Co., Ltd.

In addition, in order to prevent production of blurred images, fillers having a high electric resistance (i.e., not less than $1\times10^{10}$ Ω·cm in resistivity) are preferably used. Further, fillers having a pH not less than 5 and fillers having a dielectric constant not less than 5 can be more preferably used. Fillers having a dielectric constant not less than 5 and/or a pH not less than 5 can be used alone or in combination. In addition, combinations of a filler having a pH not less than 5 and a filler having a pH less than 5, or combinations of a filler having a dielectric constant not less than 5 and a filler having a dielectric constant less than 5, can also be used. Among these fillers, α-alumina having a closest packing structure is preferably used. This is because α-alumina has a high insulating property, a high heat stability and a good abrasion resistance, resulting in prevention of formation of blurred images and improvement of abrasion resistance of the resultant photoreceptor.

In the present application, the resistivity of a filler is defined as follows. The resistivity of a powder such as fillers largely changes depending on the filling factor of the powder when the resistivity is measured. Therefore, it is necessary to measure the resistivity under a constant condition. In the present application, the resistivity is measured by a device similar to the devices disclosed in JP-As 05-94049 and 05-113688. The surface area of the electrodes of the device is 4.0 $cm^2$. Before the resistivity of a sample powder is measured, a load of 4 kg is applied to one of the electrodes for 1 minute and the amount of the sample powder is adjusted such that the distance between the two electrodes becomes 4 mm.

The resistivity of the sample powder is measured by pressing the sample powder only by the weight (i.e., 1 kg) of the upper electrode without applying any other load to the sample. The voltage applied to the sample powder is 100 V. When the resistivity is not less than $10^6$ Ω·cm, HIGH RESISTANCEMETER (from Yokogawa Hewlett-Packard Co.) is used to measure the resistivity. When the resistivity is less than $10^6$ Ω·cm, a digital multimeter (from Fluke Corp.) is used.

The dielectric constant of a filler is measured as follows. A cell similar to that used for measuring the resistivity is also used for measuring the dielectric constant. After a load is applied to a sample powder, the capacity of the sample powder is measured using a dielectric loss measuring instrument (from Ando Electric Co., Ltd.) to determine the dielectric constant of the powder.

The fillers to be included in the protective layer are preferably subjected to a surface treatment using a surface treatment agent in order to improve the dispersion of the fillers in the protective layer. When a filler is poorly dispersed in the protective layer, the following problems occur.

(1) the residual potential of the resultant photoreceptor increases;

(2) the transparency of the resultant protective layer decreases;

(3) coating defects are formed in the resultant protective layer;

(4) the abrasion resistance of the protective layer deteriorates;

(5) the durability of the resultant photoreceptor deteriorates; and (6) the image qualities of the images produced by the resultant photoreceptor deteriorate.

Suitable surface treatment agents include known surface treatment agents. However, surface treatment agents which can maintain the highly insulative property of fillers used are preferably used.

As the surface treatment agents, titanate coupling agents, aluminum coupling agents, zircoaluminate coupling agents, higher fatty acids, combinations of these agents with a silane coupling agent, $Al_2O_3$, $TiO_2$, $ZrO_2$, silicones, aluminum stearate, and the like, can be preferably used to improve the dispersibility of fillers and to prevent formation of blurred images. These materials can be used alone or in combination.

When fillers treated with a silane coupling agent are used, the resultant photoreceptor tends to produce blurred images. However, combinations of a silane coupling agent with one of the surface treatment agents mentioned above can often produce good images without blurring.

The coating weight of the surface treatment agents is preferably from 3 to 30% by weight, and more preferably from 5 to 20% by weight, based on the weight of the treated filler although the weight is determined depending on the average primary particle diameter of the filler.

When the content of the surface treatment agent is too low, the dispersibility of the filler cannot be improved. In contrast, when the content is too high, the residual potential of the resultant photoreceptor seriously increases.

These fillers can be dispersed using a proper dispersion machine. In this case, the fillers are preferably dispersed to an extent such that the aggregated particles are dissociated and primary particles of the fillers are dispersed to improve the transparency of the resultant protective layer.

In addition, a charge transport material can be included in the protective layer to enhance the photo response property and to reduce the residual potential of the resultant photoreceptor. The charge transport materials mentioned above for use in the charge transport layer can also be used for the protective layer.

When a low molecular weight charge transport material is used for the protective layer, the concentration of the charge transport material may be changed in the thickness direction of the protective layer. Specifically, it is preferable to reduce the concentration of the charge transport material at the surface portion of the protective layer in order to improve the abrasion resistance of the resultant photoreceptor. At this point, the concentration of the charge transport material means the ratio of the weight of the charge transport material to the total weight of the protective layer.

It is preferable to use a charge transport polymer in the protective layer in order to improve the durability of the photoreceptor.

The protective layer 9 can be formed by any known coating methods. The thickness of the protective layer is preferably from 1 to 10 μm. In addition, layers of amorphous carbon or amorphous silicon carbide, which are formed by a vacuum deposition method, can also be used as the protective layer 9.

Then the image forming apparatus of the present invention will be explained in detail.

Figure 9:
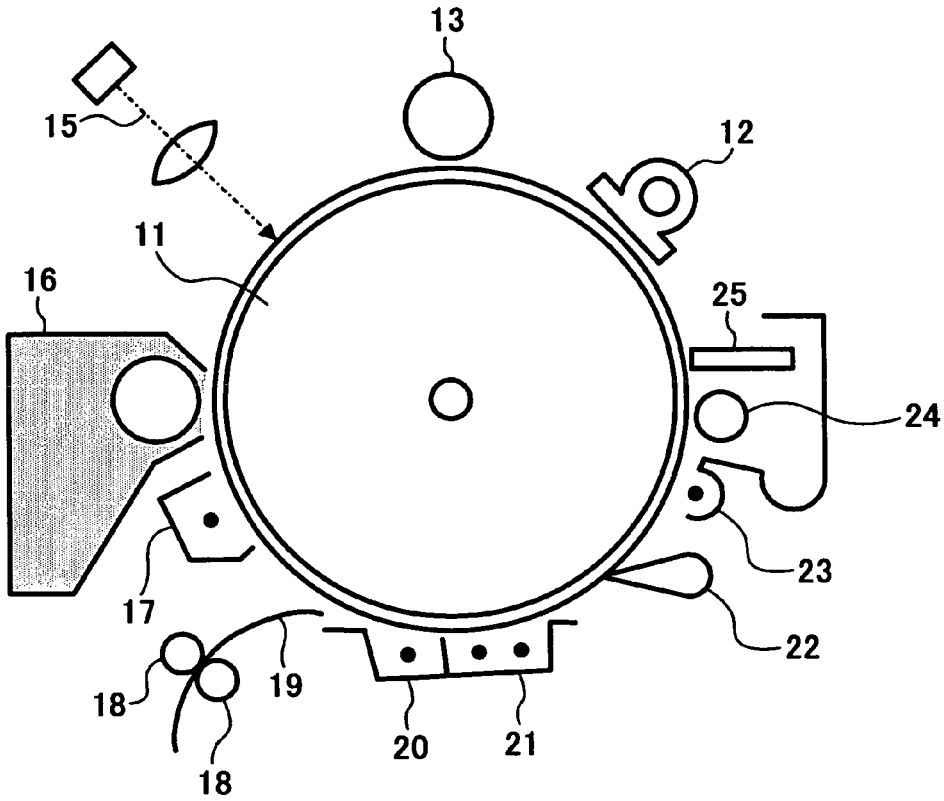
FIG. 9 is a schematic view illustrating an image forming section of an embodiment of the image forming apparatus of the present invention.

FIG. 9 is a schematic view illustrating an embodiment of the image forming apparatus of the present invention.

Referring to FIG. 9, a photoreceptor 11 is the photoreceptor of the present invention, which includes at least an electroconductive substrate, and a charge blocking layer, a moiré preventing layer, and a photosensitive layer, which are located overlying the electroconductive substrate in this order, wherein the photosensitive layer includes an azo pigment having formula (I).

Although the photoreceptor has a cylindrical form, sheet-form photoreceptors and endless belt-form photoreceptors can also be used.

Around the photoreceptor 11, a quenching lamp 12 configured to discharge the charges remaining on the photoreceptor 12, a charging device 13 configured to charge the photoreceptor 11, a light irradiator 15 configured to irradiate the photoreceptor 11 with imagewise light to form an electrostatic latent image on the photoreceptor 11, a developing device 16 configured to develop the latent image with a toner to form a toner image on the photoreceptor 11, and a cleaning unit including a cleaning brush 24 and a cleaning blade 25 configured to clean the surface of the photoreceptor 11 are arranged while contacting or being set closely to the photoreceptor 11. The toner image formed on the photoreceptor 11 is transferred on a receiving paper 19, which is fed by a pair of registration rollers 18, at a transfer device (i.e., a pair of a transfer charger 20 and a separating charger 21). The receiving paper 19 having the toner image thereon is separated from the photoreceptor 11 by a separating pick 22.

In the image forming apparatus of the present invention, a pre-transfer charger 17 and a pre-cleaning charger 23 may be arranged if desired.

As the charging device 13, the pre-transfer charger 17, the transfer charger 20, the separating charger 21 and the pre-cleaning charger 23, all known chargers such as corotrons, scorotrons, solid state chargers, roller chargers and brush chargers can be used.

As the charging devices, contact chargers such as charging rollers, charging blades and charging brushes and short-range chargers which charge a photoreceptor while a small gap is formed between the charging member and the photoreceptor can be preferably used. In particular, by using contact chargers, the amount of generated ozone can be drastically reduced, and therefore the photoreceptor can be maintained to be stable and deterioration of image qualities can be prevented even when the photoreceptor is repeatedly used. In addition, the image forming apparatus can be miniaturized.

Among the contact chargers, charging rollers and charging brushes can be preferably used in the present invention.

In the short-range chargers for use in the image forming apparatus of the present invention, the gap between a charging member and the photoreceptor to be charged is about 100 μm, and therefore the short-range chargers are different from known non-contact chargers such as corotrons and scorotrons. Any mechanisms which can maintain such a small gap between the surface of a charging member and the surface of the photoreceptor to be charged, can be used for the short-range chargers for use in the image forming apparatus of the present invention. For example, mechanisms having a constitution such that a proper gap is formed between the surface of the photoreceptor and the surface of a charging member by mechanically fixing the rotation shaft of the photoreceptor to the rotation shaft of the charging member can be used. Among these mechanisms, the following mechanisms are preferably used:

(1) A charger having a gap forming member on both sides thereof is provided. The gap forming members contact the non-image areas of the photoreceptor to form a proper gap therebetween; and (2) Gap forming members are provided on the non-image areas of the photoreceptor. The gap forming members contact the non-image forming areas of a charger to form a proper gap therebetween.

In particular, short-range chargers disclosed in JP-As. 2002-148904 and 2002-148905 are preferably used in the image forming apparatus of the present invention.

Figure 10:
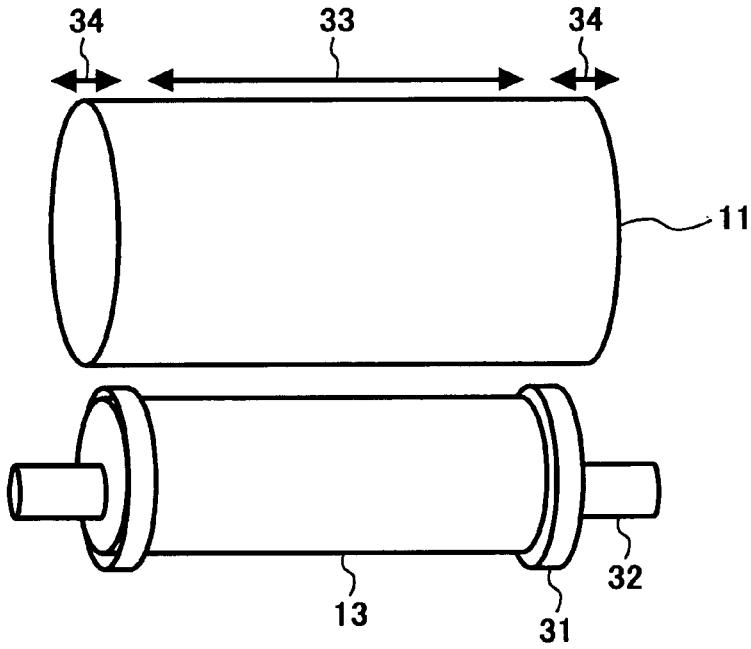
FIG. 10 is a schematic view illustrating a short range charger for use in the image forming apparatus of the present invention.
Figure 13:
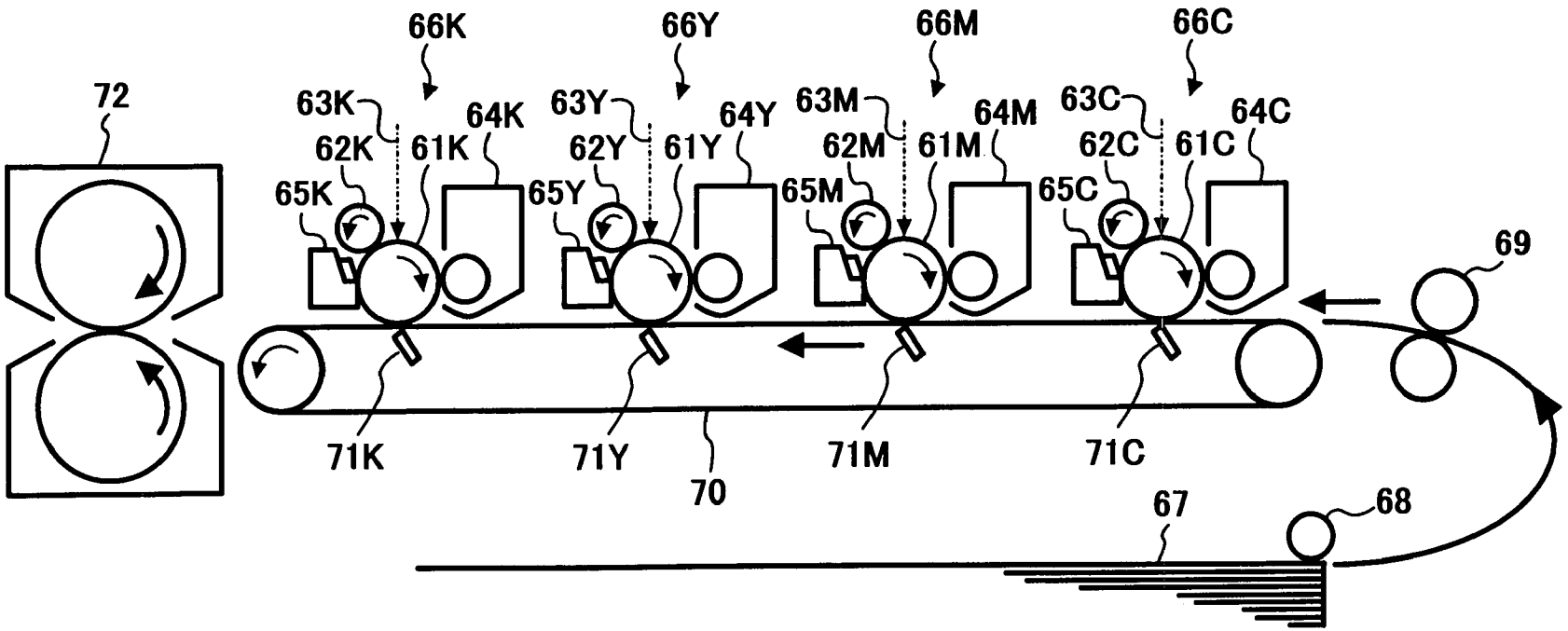
FIG. 13 is a schematic view illustrating another embodiment of the image forming apparatus of the present invention.

FIG. 10 is a schematic view illustrating an embodiment of the short-range charger for use in the image forming apparatus of the present invention, in which a gap forming member is formed on a charger. Referring to FIG. 13, numerals 11 and 13 designate the photoreceptor and charging roller, respectively. Numerals 31, 32, 33 and 34 designate a gap forming member, a metal shaft of the charging roller, an image forming area of the photoreceptor 11, and non-image areas of the photoreceptor 11, respectively. The gap forming members 31 contact the non-image areas 34 of the photoreceptor 11 to form a gap between the image forming area 33 and the charging area of the charging roller 13.

The above-mentioned short-range charger has the following advantages:

(1) the charge efficiency is high;
(2) the amount of ozone generated during charging is small;
(3) the image forming apparatus can be miniaturized;
(4) the charger is hardly contaminated by the toner used or the like materials; and
(5) the surface of the photoreceptor is hardly abraded.

In addition, it is preferable for the charger to apply a DC voltage overlapped with an AC voltage to avoid uneven charging.

When such contact chargers and short-range chargers are used, dielectric break down of the photoreceptor tends to occur. However, the photoreceptor of the present invention has good resistance to dielectric breakdown. This is because the photoreceptor has an intermediate layer including the charge blocking layer and the moiré preventing layer mentioned above, and in addition the photosensitive layer thereof include no coarse particles of charge generation materials. Therefore, the short-range chargers can be used without causing any problems such as the uneven charging problem mentioned above and the dielectric breakdown problem.

Thus the photoreceptor is charged with the charger. In conventional image forming apparatus, the photoreceptors are charged so as to have a relatively low electric field intensity (e.g., not higher than 40 V/μm, preferably not higher than 30 V/μm) to avoid background development due to the photoreceptor. Namely, when the electric field strength of a photoreceptor increases, the probability that images produced by the photoreceptor have background development increases. However, when the electric field intensity is decreased, the photo-carrier generating efficiency is also decreased, resulting in deterioration of photosensitivity of the photoreceptor. Additionally, in this case the intensity of the electric field formed between the surface of the photoreceptor and the electroconductive substrate thereof is decreased. Therefore the photo-carriers generated in the photosensitive layer cannot move straight, and scatter due to coulomb repulsion, resulting in deterioration of resolution of the electrostatic latent images formed on the photoreceptor. When the photoreceptor of the present invention is used, the probability of occurrence of background development can be extremely decreased. Therefore, it is not necessary to decrease the electric field intensity more than necessary, and the photoreceptor can be used at an electric field intensity not greater than 40 V/μm. Therefore, photo-decaying of the photoreceptor can be well performed under such conditions, and the resultant electrostatic latent images can be well developed with wide margin. Therefore, the electrostatic latent images can be developed without deteriorating the resolution thereof.

Light sources with high intensity such as light emitting diodes (LEDs), laser diodes (LDs) and electroluminescent lamps (EL) can be used for the imagewise light irradiator 15.

Suitable light sources for use in the discharging lamp 12 include fluorescent lamps, tungsten lamps, halogen lamps, mercury lamps, sodium lamps, light emitting diodes (LEDs), laser diodes (LDs), light sources using electroluminescent lamps (EL), and the like. In addition, in order to obtain light having a desired wave length range, filters such as sharp-cut filters, band pass filters, near-infrared cutting filters, dichroic filters, interference filters, color temperature converting filters and the like can be used.

Among these light sources, LEDs; and LDs are preferably used because of emitting a high energy light beam having a wavelength of from 600 nm to 800 nm, to which the above-mentioned azo pigment in the charge generation layer has high sensitivity.

The above-mentioned lamps can be used not only for the processes mentioned above and illustrated in FIG. 9, but also for other processes using light irradiation, such as a transfer process including light irradiation, a discharging process, a cleaning process including light irradiation and a pre-exposure process.

Referring to FIG. 9, when the toner image formed on the photoreceptor 11 by the developing device 16 is transferred onto the receiving paper 19, all of the toner particles of the toner image are not transferred on the receiving paper 19, and toner particles remain on the surface of the photoreceptor 11. The residual toner particles are removed from the photoreceptor 11 by the fur blush 24 or the cleaning blade 25. The residual toner particles remaining on the photoreceptor 11 can be removed only by a cleaning brush. Suitable cleaning blushes include known cleaning blushes such as fur blushes and mag-fur blushes.

When the photoreceptor 11 which is previously charged positively (or negatively) is exposed to imagewise light, an electrostatic latent image having a positive (or negative) charge is formed on the photoreceptor 11. When the latent image having a positive (or negative) charge is developed with a toner having a negative (or positive) charge, a positive image can be obtained. In contrast, when the latent image having a positive (negative) charge is developed with a toner having a positive (negative) charge, a negative image (i.e., a reversal image) can be obtained. As the developing method, known developing methods can be used. In addition, as the discharging methods, known discharging methods can also be used.

Figure 11:
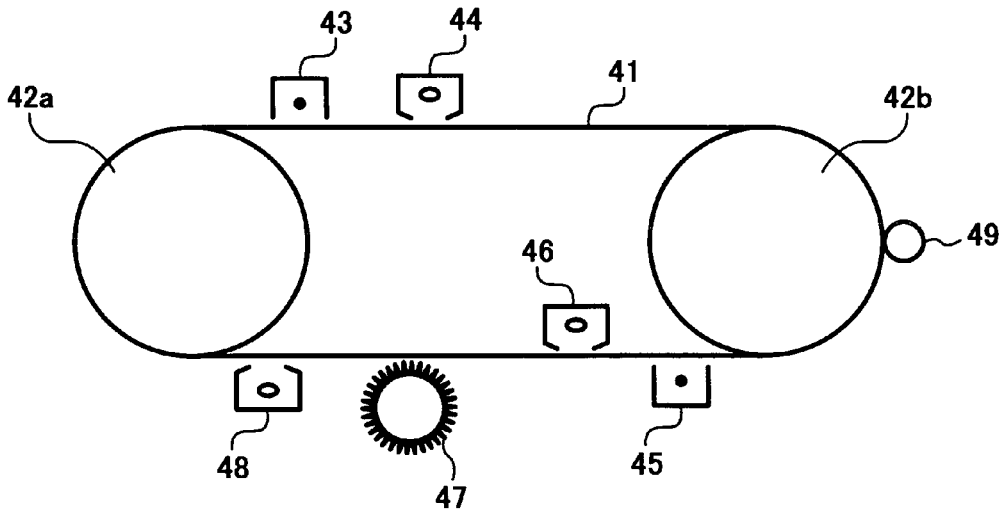
FIG. 11 is a schematic view illustrating an image forming section of another embodiment of the image forming apparatus of the present invention.

FIG. 11 illustrates another embodiment of the image forming apparatus of the present invention. Numeral 41 designates a photoreceptor which is the photoreceptor of the mentioned above.

Referring to FIG. 11, the photoreceptor 41 has a belt-form. The photoreceptor 41 is rotated by rollers 42*a* and 42*b*. The photoreceptor 41 is charged with a charger 43, and then exposed to imagewise light emitted by a light irradiating device 44 to form an electrostatic latent image on the photoreceptor 41. The latent image is developed with a developing device 49 to form a toner image on the photoreceptor 41. The toner image is transferred onto a receiving paper (not shown) using a transfer charger 45. After the toner image transferring process, the surface of the photoreceptor 41 is cleaned with a cleaning brush 47 after performing a pre-cleaning light irradiating operation using a pre-cleaning light irradiator 46. Then the photoreceptor 41 is discharged by being exposed to light emitted by a discharging light source 48. In the pre-cleaning light irradiating process, light irradiates the photoreceptor 41 from the substrate side of the photoreceptor 41. In this case, the substrate has to be light-transmissive.

The image forming apparatus of the present invention is not limited to the image forming apparatus as shown in FIGS. 9 and 11. For example, in FIG. 11, the pre-cleaning light irradiating operation can be performed from the photosensitive layer side of the photoreceptor 41. In addition, the light irradiation in the light image irradiating process and the discharging process may be performed from the substrate side of the photoreceptor 41.

Further, a pre-transfer light irradiation operation, which is performed before the transferring of the toner image, and a preliminary light irradiation operation, which is performed before the imagewise light irradiation, and other light irradiation operations may also be performed.

The above-mentioned image forming unit may be fixedly set in an image forming apparatus such as copiers, facsimiles and printers. However, the image forming unit may be set therein as a process cartridge. The process cartridge means an image forming unit which includes a photoreceptor and at least one of a charging device, a light irradiating device, a developing device, a transferring device, a cleaning device and a discharging device.

Figure 12:
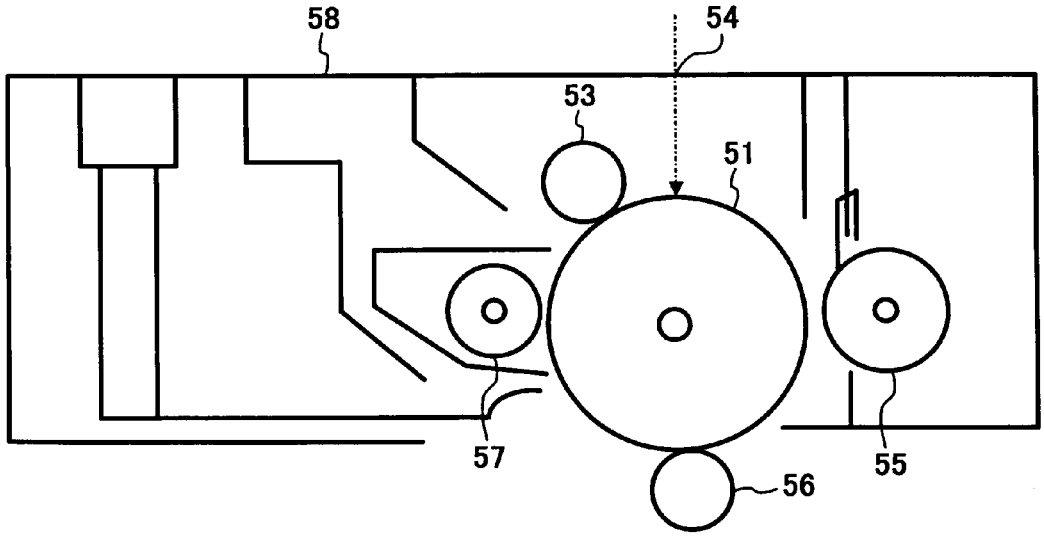
FIG. 12 is a schematic view illustrating an embodiment of the process cartridge of the present invention.

FIG. 12 is a schematic view illustrating an embodiment of the process cartridge of the present invention. In FIG. 12, the process cartridge includes a photoreceptor 51 which is the photoreceptor of the present invention, a charging roller 53 configured to charge the photoreceptor 51, a light irradiating section configured to irradiate the photoreceptor 51 with imagewise light 54 to form an electrostatic latent image on the photoreceptor 51, a developing device (a developing roller) 55 configured to develop the latent image with a toner, a transferring device 56 configured to transfer the toner image onto a receiving paper, a cleaning brush 57 configured to clean the surface of the photoreceptor 51, and a housing 58.

Then, a full color image forming apparatus which is an embodiment of the image forming apparatus of the present invention will be explained.

FIG. 13 is a schematic view illustrating another embodiment of the image forming apparatus (a tandem type image forming apparatus) of the present invention, which includes plural image forming units. However, the image forming apparatus of the present invention is not limited thereto.

In FIG. 13, the tandem type image forming apparatus has a cyan image forming unit 66C, a magenta image forming unit 66M, a yellow image forming unit 66Y and a black image forming unit 66K. Drum photoreceptors 61C, 61M, 61Y and 61K, which are the photoreceptor of the present invention, rotate in the direction indicated by the respective arrows. Around the photoreceptors 61C, 61M, 61Y and 61K, charging devices 62C, 62M, 62Y and 62K, developing devices 64C, 64M, 64Y and 64K, and cleaning devices 65C, 65M, 65Y and 65K are arranged in this order in the clockwise direction. As the charging devices, the above-mentioned charging devices which can uniformly charge the surface of the photoreceptors are preferably used. Light irradiating devices irradiate a surface of the respective photoreceptors located between the chargers and the image developers with laser light beams 63C, 63M, 63Y and 63K to form an electrostatic latent image on the respective photoreceptors. The four image forming units 66C, 66M, 66Y and 66K are arranged along a transfer belt 70. The transfer belt 70 contacts the respective photoreceptors 61C, 61M, 61Y and 61K at image transfer points located between the respective developing devices and the respective cleaning devices to receive color images formed on the photoreceptors. At the backsides of the image transfer points of the transfer belt 70, transfer brushes 71C, 71M, 71Y and 71K are arranged to apply a transfer bias to the transfer belt 70.

The image forming process will be explained referring to FIG. 13.

At first, in each of the image forming units 66C, 66M, 66Y and 66K, the photoreceptor 61C, 61M, 61Y and 61K are charged with the respective charging devices 62C, 62M, 62Y and 62K which rotate in the direction indicated by the arrows. Then light irradiating devices (not shown) irradiates each of the photoreceptors 61C, 61M, 61Y and 61K with respective laser light beams 63C, 63M, 63Y and 63K to form an electrostatic latent image on each photoreceptor.

Then the electrostatic latent image on each photoreceptor is developed with the corresponding developing device 64C, 64M, 64Y or 64K including a color toner C, M, Y or K to form a color toner image on each photoreceptor. The thus prepared color toner images are transferred onto a receiving material 67 fed from a paper tray.

The receiving material 67 is fed by a feeding roller 68 and stops at a pair of registration rollers 69, and is timely fed to the transfer belt 70 such that the color toner images formed on each photoreceptor are transferred onto proper positions of the receiving material 67. Each of the toner images on the photoreceptors is transferred onto the receiving material 67 at the contact point (i.e., the transfer position) of the photoreceptor with the receiving material 67.

The toner image on each photoreceptor is transferred onto the receiving material 67 due to an electric field which is formed due to the difference between the transfer bias voltage and the potential of the photoreceptor. After passing through the four transfer positions, the receiving material 67 having the color toner images thereon is then transported to a fixer 72 so that the color toner images are fixed to the receiving material 67. Then the receiving material 67 is discharged from the main body of the image forming apparatus. Toner particles, which remain on the photoreceptors even after the transfer process, are collected by respective cleaning devices 65C, 65M, 65Y and 65K.

In the image forming apparatus, the image forming units 66C, 66M, 66Y and 66K are arranged in this order in the paper feeding direction, but the order is not limited thereto. In addition, although the color toner images are directly transferred onto a receiving material in this image forming apparatus, the toner images can be transferred to the receiving material via an intermediate transfer medium.

When a black and white image is formed, the other image forming units 66C, 66M and 66Y may be stopped. In addition, in FIG. 13, the charging devices 62C, 62M, 62Y and 62K contact the respective photoreceptors 61C, 61M, 61Y and 61K, but the charging devices may be short-range chargers in which a proper gap of from 10 to 200 μm is formed between the charging members and the respective photoreceptors. Such short-range chargers have advantages such that the abrasion of the photoreceptors and the charging devices can be reduced, and in addition a toner film is hardly formed on the charging members.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Dispersion Preparation Example 1

A dispersion (i.e., a charge generation layer coating liquid) was prepared using the following components.

| | |
|---|---|
| Azo pigment having the following formula | 5 parts |

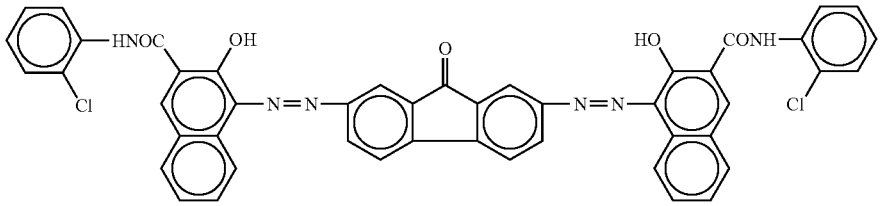

| | |
|---|---|
| Polyvinyl butyral (S-LEC BX-1 from Sekisui Chemical Co., Ltd.) | 2 parts |
| Cyclohexanone | 250 parts |
| 2-butanone | 100 parts |

At first, the polyvinyl butyral resin was dissolved in a mixture of 2-butanone and cyclohexanone. Then the azo pigment was mixed with the resin solution and the mixture was subjected to a dispersion treatment for 7 days using a ball mill which includes PSZ balls with a particle diameter of 10 mm and which is rotated at a revolution of 85 rpm. Thus, a dispersion 1 was prepared.

Dispersion Preparation Example 2

The procedure for preparation of the dispersion 1 was repeated except that the azo pigment was replaced with an azo pigment having the following formula.

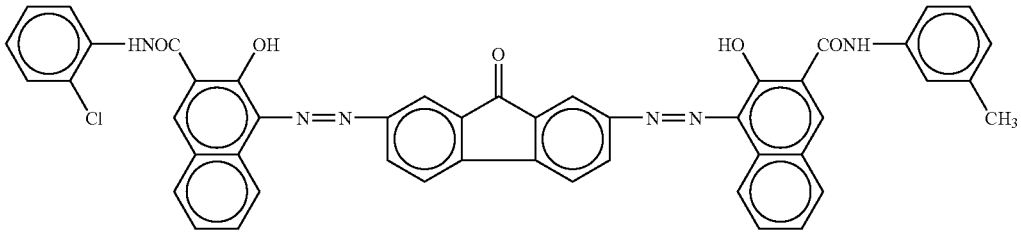

Thus, a dispersion 2 was prepared.

Dispersion Preparation Example 3

The procedure for preparation of the dispersion 1 was repeated except that the azo pigment was replaced with an azo pigment having the following formula.

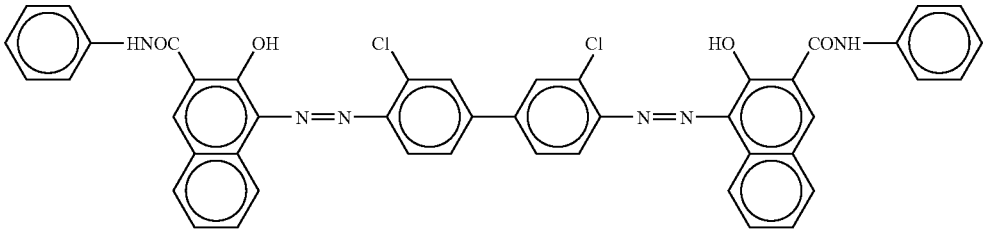

Thus, a dispersion 3 was prepared.

Dispersion Preparation Example 4

The dispersion 2 prepared in Dispersion Preparation Example 2 was subjected to a filtering treatment using a cotton wind cartridge filter TCW-3-CS with an effective pore diameter of 3 μm, which is manufactured by ADVANTECH, while applying a pressure to the dispersion using a pump. Thus, a dispersion 4 was prepared.

Dispersion Preparation Example 5

The dispersion 2 prepared in Dispersion Preparation Example 2 was subjected to a filtering treatment using a cotton wind cartridge filter TCW-5-CS with an effective pore diameter of 5 μm, which is manufactured by ADVANTECH, while applying a pressure to the dispersion using a pump. Thus, a dispersion 5 was prepared.

Dispersion Preparation Example 6

The procedure for preparation of the dispersion 2 was repeated except that the dispersion was performed for 2 days at a revolution of 85 rpm. Thus, a dispersion 6 was prepared.

Dispersion Preparation Example 7

The dispersion 6 prepared in Dispersion Preparation Example 6 was subjected to a filtering treatment using a cotton wind cartridge filter TCW-5-CS with an effective pore diameter of 5 μm, which is manufactured by ADVANTECH, while applying a pressure to the dispersion using a pump. However, the filter was clogged with coarse particles of the dispersion 6, and therefore all the dispersion could not be filtered. Therefore, the dispersion could not be evaluated.

The particle diameter distributions of the pigment particles in the thus prepared dispersions 1-6 were determined using an instrument CAPA 700 from Horiba Ltd.

The results are shown in Table 1.

TABLE 1

| Dispersion | Average particle diameter (μm) | Standard Deviation (μm) |
|---|---|---|
| 1 | 0.27 | 0.18 |
| 2 | 0.26 | 0.17 |
| 3 | 0.26 | 0.17 |
| 4 | 0.23 | 0.15 |
| 5 | 0.25 | 0.16 |
| 6 | 0.33 | 0.23 |

Example 1

Preparation of Charge Blocking Layer

The following components were mixed to prepare a charge blocking layer coating liquid.

| | |
|---|---|
| Alcohol-soluble nylon (AMILAN CM8000 from Toray Ltd.) | 4 parts |
| Methanol | 70 parts |
| n-butanol | 30 parts |

The thus prepared charge blocking layer coating liquid was coated on an aluminum drum (specified in JIS1050), which has an outside diameter of 60 mm, and the coated liquid was dried to form a charge blocking layer having a thickness of 0.5 μm.

Preparation of Moiré Preventing Layer

The following components were mixed to prepare a moiré preventing layer coating liquid.

| | |
|---|---|
| Titanium oxide (CR-EL from Ishihara Sangyo Kaisha Ltd., average particle diameter of 0.25 μm) | 84 parts |
| Alkyd resin (BEKKOLITE M6401-50-S from Dainippon Ink & Chemicals, Inc., solid content of 50%) | 33.6 parts |
| Melamine resin (SUPER BEKKAMIN L-121-60 from Dainippon Ink & Chemicals, Inc., solid content of 60%) | 18.7 parts |
| 2-butanone | 100 parts |

The thus prepared moiré preventing layer coating liquid was coated on the charge blocking layer, and the coated liquid was dried to form a moiré preventing layer having a thickness of 3.5 μm.

In this case, the volume ratio of the inorganic pigment (titanium oxide) to the binder resin is 1/1. The weight ratio of the alkyd resin to the melamine resin is 6/4.

Preparation of Charge Generation Layer

Dispersion 1 prepared above was coated on the moiré preventing layer, and the coated liquid was dried to form a charge generation layer. The thickness of the charge generation layer was adjusted such that the charge generation layer has a transmittance of 20% against light with a wavelength of 655 nm. In this regard, the transmittance was determined as follows:

(1) the charge generation layer coating liquid is coated on a polyethylene terephthalate film wound on an aluminum cylinder which is the same as the aluminum cylinder mentioned above;

(2) the coated liquid is dried to form a charge generation layer on the polyethylene terephthalate film; and (3) the transmittance of the film bearing the charge generation layer against light with a wavelength of 655 nm is measured with a spectrophotometer (UV-3100 from Shimadzu Corp.) while compared with the transmittance of the film bearing no charge generation layer thereon.

Preparation of Charge Transport Layer

The following components were mixed to prepare a CTL coating liquid.

| | |
|---|---|
| Polycarbonate (TS2050 from Teijin Chemicals Ltd.) | 10 parts |
| CTM having the following formula | 7 parts |

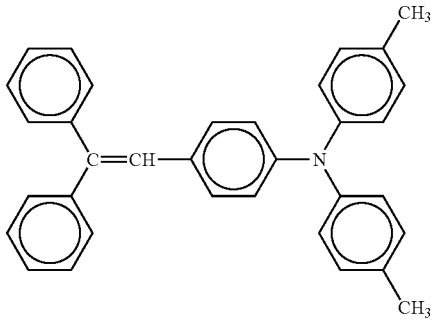

| | |
|---|---|
| Methylene chloride | 80 parts |

The thus prepared charge transport layer coating liquid was coated on the charge generation layer and then dried. Thus a charge transport layer having a thickness of 23 μm was prepared.

Thus, a photoreceptor of Example 1 was prepared.

Examples 2 to 5 and Comparative Example 1

The procedure for preparation of the photoreceptor 1 in Example 1 was repeated except that the dispersion 1 was replaced with each of the dispersions 2 to 6, to prepare photoreceptors of Examples 2 to 5 and Comparative Example 1. The numbers of the dispersions used for the photoreceptors are described in Table 2.

Comparative Example 2

The procedure for preparation of the photoreceptor in Example 3 was repeated except that the charge blocking layer was not formed. Thus, a photoreceptor of Comparative Example 2 was prepared.

Comparative Example 3

The procedure for preparation of the photoreceptor in Example 3 was repeated except that the moiré preventing layer was not formed. Thus, a photoreceptor of Comparative Example 3 was prepared.

Comparative Example 4

The procedure for preparation of the photoreceptor in Example 3 was repeated except that the position of the charge blocking layer and the moiré preventing layer was reversed (i.e., the charge blocking layer was formed on the moiré preventing layer formed on the substrate). Thus, a photoreceptor of Comparative Example 4 was prepared.

Example 6

The procedure for preparation of the photoreceptor in Example 3 was repeated except that the thickness of the charge blocking layer was changed to 0.3 μm. Thus, a photoreceptor of Example 6 was prepared.

Example 7

The procedure for preparation of the photoreceptor in Example 3 was repeated except that the thickness of the charge blocking layer was changed to 1.0 μm. Thus, a photoreceptor of Example 7 was prepared.

Example 8

The procedure for preparation of the photoreceptor in Example 3 was repeated except that the thickness of the charge blocking layer was changed to 2.0 μm. Thus, a photoreceptor of Example 8 was prepared.

Example 9

The procedure for preparation of the photoreceptor in Example 3 was repeated except that the thickness of the charge blocking layer was changed to 0.1 μm. Thus, a photoreceptor of Example 9 was prepared.

Example 10

The procedure for preparation of the photoreceptor in Example 3 was repeated except that the formula of the moiré preventing layer coating liquid was changed as follows.

| Formula of moiré preventing layer coating liquid | |
|---|---|
| Titanium oxide (CR-EL from Ishihara Sangyo Kaisha Ltd., average particle diameter of 0.25 μm) | 252 parts |
| Alkyd resin (BEKKOLITE M6401-50-S from Dainippon Ink & Chemicals, Inc., solid content of 50%) | 33.6 parts |

-continued

| Formula of moiré preventing layer coating liquid | |
|---|---|
| Melamine resin (SUPER BEKKAMIN L-121-60 from Dainippon Ink & Chemicals, Inc., solid content of 60%) | 18.7 parts |
| 2-butanone | 300 parts |

In this case, the volume ratio of the inorganic pigment (titanium oxide) to the binder resin is 3/1. The weight ratio of the alkyd resin to the melamine resin is 6/4.

Example 11

The procedure for preparation of the photoreceptor in Example 3 was repeated except that the formula of the moiré preventing layer coating liquid was changed as follows.

| Formula of moiré preventing layer coating liquid | |
|---|---|
| Titanium oxide (CR-EL from Ishihara Sangyo Kaisha Ltd., average particle diameter of 0.25 μm) | 58.8 parts |
| Alkyd resin (BEKKOLITE M6401-50-S from Dainippon Ink & Chemicals, Inc., solid content of 50%) | 33.6 parts |
| Melamine resin (SUPER BEKKAMIN L-121-60 from Dainippon Ink & Chemicals, Inc., solid content of 60%) | 18.7 parts |
| 2-butanone | 150 parts |

In this case, the volume ratio of the inorganic pigment (titanium oxide) to the binder resin is 0.7/1. The weight ratio of the alkyd resin to the melamine resin is 6/4.

Example 12

The procedure for preparation of the photoreceptor in Example 3 was repeated except that the formula of the moiré preventing layer coating liquid was changed as follows.

| Formula of moiré preventing layer coating liquid | |
|---|---|
| Titanium oxide (CR-EL from Ishihara Sangyo Kaisha Ltd., average particle diameter of 0.25 μm) | 336 parts |
| Alkyd resin (BEKKOLITE M6401-50-S from Dainippon Ink & Chemicals, Inc., solid content of 50%) | 33.6 parts |
| Melamine resin (SUPER BEKKAMIN L-121-60 from Dainippon Ink & Chemicals, Inc., solid content of 60%) | 18.7 parts |
| 2-butanone | 350 parts |

In this case, the volume ratio of the inorganic pigment (titanium oxide) to the binder resin is 4/1. The weight ratio of the alkyd resin to the melamine resin is 6/4.

Example 13

The procedure for preparation of the photoreceptor in Example 3 was repeated except that the formula of the charge blocking layer coating liquid was changed as follows.

| Formula of charge blocking layer coating liquid | |
|---|---|
| Alkyd resin (BEKKOLITE M6401-50-S from Dainippon Ink & Chemicals, Inc., solid content of 50%) | 33.6 parts |
| Melamine resin (SUPER BEKKAMIN L-121-60 from Dainippon Ink & Chemicals, Inc., solid content of 60%) | 18.7 parts |
| 2-butanone | 500 parts |

Example 14

The procedure for preparation of the photoreceptor in Example 3 was repeated except that the formula of the moiré preventing layer coating liquid was changed as follows.

| Formula of moiré preventing layer coating liquid | |
|---|---|
| Zinc oxide (SAZEX 4000 from Sakai Chemical Industry Co., Ltd.) | 110 parts |
| Alkyd resin (BEKKOLITE M6401-50-S from Dainippon Ink & Chemicals, Inc., solid content of 50%) | 33.6 parts |
| Melamine resin (SUPER BEKKAMIN L-121-60 from Dainippon Ink & Chemicals, Inc., solid content of 60%) | 18.7 parts |
| 2-butanone | 120 parts |

In this case, the volume ratio of the inorganic pigment (zinc oxide) to the binder resin is 1/1. The weight ratio of the alkyd resin to the melamine resin is 6/4.

Example 15

The procedure for preparation of the photoreceptor in Example 5 was repeated except that the formula of the moiré preventing layer coating liquid was changed as follows.

| Formula of moiré preventing layer coating liquid | |
|---|---|
| Titanium oxide (CR-EL from Ishihara Sangyo Kaisha Ltd., average particle diameter of 0.25 μm) | 84 parts |
| Alkyd resin (BEKKOLITE M6401-50-S from Dainippon Ink & Chemicals, Inc., solid content of 50%) | 22.4 parts |
| Melamine resin (SUPER BEKKAMIN L-121-60 from Dainippon Ink & Chemicals, Inc., solid content of 60%) | 28 parts |
| 2-butanone | 100 parts |

In this case, the volume ratio of the inorganic pigment (titanium oxide) to the binder resin is 1/1. The weight ratio of the alkyd resin to the melamine resin is 4/6.

Example 16

The procedure for preparation of the photoreceptor in Example 3 was repeated except that the formula of the moiré preventing layer coating liquid was changed as follows.

| Formula of moiré preventing layer coating liquid | |
|---|---|
| Titanium oxide (CR-EL from Ishihara Sangyo Kaisha Ltd., average particle diameter of 0.25 μm) | 84 parts |
| Alkyd resin (BEKKOLITE M6401-50-S from Dainippon Ink & Chemicals, Inc., solid content of 50%) | 28 parts |
| Melamine resin (SUPER BEKKAMIN L-121-60 from Dainippon Ink & Chemicals, Inc., solid content of 60%) | 23.3 parts |
| 2-butanone | 100 parts |

In this case, the volume ratio of the inorganic pigment (titanium oxide) to the binder resin is 1/1. The weight ratio of the alkyd resin to the melamine resin is 5/5.

Example 17

The procedure for preparation of the photoreceptor in Example 3 was repeated except that the formula of the moiré preventing layer coating liquid was changed as follows.

| Formula of moiré preventing layer coating liquid | |
|---|---|
| Titanium oxide (CR-EL from Ishihara Sangyo Kaisha Ltd., average particle diameter of 0.25 μm) | 84 parts |
| Alkyd resin (BEKKOLITE M6401-50-S from Dainippon Ink & Chemicals, Inc., solid content of 50%) | 39.2 parts |
| Melamine resin (SUPER BEKKAMIN L-121-60 from Dainippon Ink & Chemicals, Inc., solid content of 60%) | 14 parts |
| 2-butanone | 100 parts |

In this case, the volume ratio of the inorganic pigment (titanium oxide) to the binder resin is 1/1. The weight ratio of the alkyd resin to the melamine resin is 7/3.

Example 18

The procedure for preparation of the photoreceptor in Example 3 was repeated except that the formula of the moiré preventing layer coating liquid was changed as follows.

| Formula of moiré preventing layer coating liquid | |
|---|---|
| Titanium oxide (CR-EL from Ishihara Sangyo Kaisha Ltd., average particle diameter of 0.25 μm) | 84 parts |
| Alkyd resin (BEKKOLITE M6401-50-S from Dainippon Ink & Chemicals, Inc., solid content of 50%) | 44.8 parts |
| Melamine resin (SUPER BEKKAMIN L-121-60 from Dainippon Ink & Chemicals, Inc., solid content of 60%) | 9.3 parts |
| 2-butanone | 100 parts |

In this case, the volume ratio of the inorganic pigment (titanium oxide) to the binder resin is 1/1. The weight ratio of the alkyd resin to the melamine resin is 8/2.

Example 19

The procedure for preparation of the photoreceptor in Example 3 was repeated except that the formula of the moiré preventing layer coating liquid was changed as follows.

| Formula of moiré preventing layer coating liquid | |
|---|---|
| Titanium oxide (CR-EL from Ishihara Sangyo Kaisha Ltd., average particle diameter of 0.25 μm) | 84 parts |
| Alkyd resin (BEKKOLITE M6401-50-S from Dainippon Ink & Chemicals, Inc., solid content of 50%) | 50.4 parts |
| Melamine resin (SUPER BEKKAMIN L-121-60 from Dainippon Ink & Chemicals, Inc., solid content of 60%) | 4.7 parts |
| 2-butanone | 100 parts |

In this case, the volume ratio of the inorganic pigment (titanium oxide) to the binder resin is 1/1. The weight ratio of the alkyd resin to the melamine resin is 9/1.

Example 20

The procedure for preparation of the photoreceptor in Example 3 was repeated except that the formula of the moiré preventing layer coating liquid was changed as follows.

| Formula of moiré preventing layer coating liquid | |
|---|---|
| Titanium oxide (CR-EL from Ishihara Sangyo Kaisha Ltd., average particle diameter of 0.25 μm) | 84 parts |
| Alcohol-soluble nylon (AMILAN CM800 from Toray Ltd.) | 24 parts |
| Methanol | 300 parts |
| 2-butanone | 130 parts |

In this case, the volume ratio of the inorganic pigment (titanium oxide) to the binder resin is 1/1.

Example 21

The procedure for preparation of the photoreceptor in Example 3 was repeated except that the formula of the moiré preventing layer coating liquid was changed as follows.

| Formula of moiré preventing layer coating liquid | |
|---|---|
| Titanium oxide (CR-EL from Ishihara Sangyo Kaisha Ltd., average particle diameter of 0.25 μm) | 42 parts |
| Titanium oxide (PT-401M from Ishihara Sangyo Kaisha Ltd., average particle diameter of 0.07 μm) | 42 parts |
| Alkyd resin (BEKKOLITE M6401-50-S from Dainippon Ink & Chemicals, Inc., solid content of 50%) | 33.6 parts |
| Melamine resin (SUPER BEKKAMIN L-121-60 | 18.7 parts |

-continued

| Formula of moiré preventing layer coating liquid | |
|---|---|
| from Dainippon Ink & Chemicals, Inc., solid content of 60%) | |
| 2-butanone | 100 parts |

In this case, the volume ratio of the inorganic pigment (titanium oxide) to the binder resin is 1/1, and the weight ratio of the alkyd resin to the melamine resin is 6/4. The ratio of the particle diameter of the smaller titanium oxide (PT-401M) to the larger titanium oxide (CR-EL) is 0.28 and the weight ratio (PT-401M/(PT-401M+CR-EL)) is 0.5.

Example 22

The procedure for preparation of the photoreceptor in Example 3 was repeated except that the formula of the moiré preventing layer coating liquid was changed as follows.

| Formula of moiré preventing layer coating liquid | |
|---|---|
| Titanium oxide (CR-EL from Ishihara Sangyo Kaisha Ltd., average particle diameter of 0.25 μm) | 75.6 parts |
| Titanium oxide (PT-401M from Ishihara Sangyo Kaisha Ltd., average particle diameter of 0.07 μm) | 8.4 parts |
| Alkyd resin (BEKKOLITE M6401-50-S from Dainippon Ink & Chemicals, Inc., solid content of 50%) | 33.6 parts |
| Melamine resin (SUPER BEKKAMIN L-121-60 from Dainippon Ink & Chemicals, Inc., solid content of 60%) | 18.7 parts |
| 2-butanone | 100 parts |

In this case, the volume ratio of the inorganic pigment (titanium oxide) to the binder resin is 1/1, and the weight ratio of the alkyd resin to the melamine resin is 6/4. The ratio of the particle diameter of the smaller titanium oxide (PT-401M) to the larger titanium oxide (CR-EL) is 0.28 and the weight ratio (PT-401M/(PT-401M+CR-EL)) is 0.1.

Example 23

The procedure for preparation of the photoreceptor in Example 3 was repeated except that the formula of the moiré preventing layer coating liquid was changed as follows.

| Formula of moiré preventing layer coating liquid | |
|---|---|
| Titanium oxide (CR-EL from Ishihara Sangyo Kaisha Ltd., average particle diameter of 0.25 μm) | 8.4 parts |
| Titanium oxide (PT-401M from Ishihara Sangyo Kaisha Ltd., average particle diameter of 0.07 μm) | 75.6 parts |
| Alkyd resin (BEKKOLITE M6401-50-S from Dainippon Ink & Chemicals, Inc., solid content of 50%) | 33.6 parts |

-continued

| Formula of moiré preventing layer coating liquid | |
|---|---|
| Melamine resin (SUPER BEKKAMIN L-121-60 from Dainippon Ink & Chemicals, Inc., solid content of 60%) | 18.7 parts |
| 2-butanone | 100 parts |

In this case, the volume ratio of the inorganic pigment (titanium oxide) to the binder resin is 1/1, and the weight ratio of the alkyd resin to the melamine resin is 6/4. The ratio of the particle diameter of the smaller titanium oxide (PT-401M) to the larger titanium oxide (CR-EL) is 0.28 and the weight ratio (PT-401M/(PT-401M+CR-EL)) is 0.9.

Example 24

The procedure for preparation of the photoreceptor in Example 3 was repeated except that the formula of the moiré preventing layer coating liquid was changed as follows.

| Formula of moiré preventing layer coating liquid | |
|---|---|
| Titanium oxide (CR-EL from Ishihara Sangyo Kaisha Ltd., average particle diameter of 0.25 μm) | 42 parts |
| Titanium oxide (TTO-F1 from Ishihara Sangyo Kaisha Ltd., average particle diameter of 0.04 μm) | 42 parts |
| Alkyd resin (BEKKOLITE M6401-50-S from Dainippon Ink & Chemicals, Inc., solid content of 50%) | 33.6 parts |
| Melamine resin (SUPER BEKKAMIN L-121-60 from Dainippon Ink & Chemicals, Inc., solid content of 60%) | 18.7 parts |
| 2-butanone | 100 parts |

In this case, the volume ratio of the inorganic pigment (titanium oxide) to the binder resin is 1/1, and the weight ratio of the alkyd resin to the melamine resin is 6/4. The ratio of the particle diameter of the smaller titanium oxide (TTO-F1) to the larger titanium oxide (CR-EL) is 0.16 and the weight ratio (TTO-F1/(TTO-F1+CR-EL)) is 0.5.

Example 25

The procedure for preparation of the photoreceptor in Example 3 was repeated except that the formula of the moiré preventing layer coating liquid was changed as follows.

| Formula of moiré preventing layer coating liquid | |
|---|---|
| Titanium oxide (CR-EL from Ishihara Sangyo Kaisha Ltd., average particle diameter of 0.25 μm) | 42 parts |
| Titanium oxide (A-100 from Ishihara Sangyo Kaisha Ltd., average particle diameter of 0.15 μm) | 42 parts |
| Alkyd resin (BEKKOLITE M6401-50-S from Dainippon Ink & Chemicals, Inc., solid content of 50%) | 33.6 parts |
| Melamine resin (SUPER BEKKAMIN L-121-60 from Dainippon Ink & Chemicals, Inc., solid content of 60%) | 18.7 parts |
| 2-butanone | 100 parts |

In this case, the volume ratio of the inorganic pigment (titanium oxide) to the binder resin is 1/1, and the weight ratio of the alkyd resin to the melamine resin is 6/4. The ratio of the particle diameter of the smaller titanium oxide (A-100) to the larger titanium oxide (CR-EL) is 0.6 and the weight ratio (A-100/(A-100+CR-EL)) is 0.5.

Evaluation (Evaluation Method 1)

Each of the thus prepared photoreceptors was set in an image forming apparatus having a constitution as illustrated in FIG. 9. The image forming apparatus includes a laser diode which emits light having a wavelength of 655 nm and which serves as the light irradiating device; a polygon mirror configured to scan the light for optical writing; a charging roller; and a transfer device including a transfer belt. A running test in which 200,000 images of an original with an image area proportion of 6% are continuously reproduced was performed on each photoreceptor using a A-4 size plain paper, followed by production of white solid images and half tone images. The image forming conditions are as follows.

(1) environmental conditions: 22° C. and 55% RH (2) charging conditions:

DC bias: −950 V

AC bias: 2.0 kV (peak to peak voltage)

1.5 kHz (frequency)

The image qualities of the white solid images and half tone images, i.e., background development, moiré fringes and image density, were checked. The background development was graded into the following four ranks:

◎: excellent

○: good

Δ: slightly bad

X: bad

The results are shown in Table 2.

TABLE 2

| | | Image qualities | |
|---|---|---|---|
| Photoreceptor | Dispersion used | Background development | Other image qualities |
| Ex. 1 | Dispersion 1 | ○-Δ | Slightly low image density (still acceptable) |
| Ex. 2 | Dispersion 2 | ○ | Good |
| Comp. Ex. 1 | Dispersion 3 | ○-Δ | Low image density |
| Ex. 3 | Dispersion 4 | ◎-○ | Excellent |
| Ex. 4 | Dispersion 5 | ○ | Good |

TABLE 2-continued

| Photoreceptor | Dispersion used | Image qualities: Background development | Image qualities: Other image qualities |
|---|---|---|---|
| Ex. 5 | Dispersion 6 | Δ | Slightly low image density (still acceptable) |
| Comp. Ex. 2 | Dispersion 4 | X | Background development, dielectric breakdown |
| Comp. Ex. 3 | Dispersion 4 | ○ | Moire fringes |
| Comp. Ex. 4 | Dispersion 4 | ◎-○ | Low image density |
| Ex. 6 | Dispersion 4 | ○ | Good |
| Ex. 7 | Dispersion 4 | ◎ | Good |
| Ex. 8 | Dispersion 4 | ◎ | Slightly low image density (still acceptable) |
| Ex. 9 | Dispersion 4 | ○ | Extremely slight background development (still acceptable) |
| Ex. 10 | Dispersion 4 | ◎ | Good |
| Ex. 11 | Dispersion 4 | ◎-○ | Extremely slight moiré fringes (still acceptable) |
| Ex. 12 | Dispersion 4 | ○ | Extremely slight background development (still acceptable) |
| Ex. 13 | Dispersion 4 | ◎-○ | Slightly low image density (still acceptable) |
| Ex. 14 | Dispersion 4 | ○-Δ | Extremely slight background development (still acceptable) |
| Ex. 15 | Dispersion 4 | ○ | Slightly low image density (still acceptable) |
| Ex. 16 | Dispersion 4 | ◎-○ | Good |
| Ex. 17 | Dispersion 4 | ◎-○ | Good |
| Ex. 18 | Dispersion 4 | ◎-○ | Good |
| Ex. 19 | Dispersion 4 | ○ | Extremely slight background development (still acceptable) |
| Ex. 20 | Dispersion 4 | ◎-○ | Slightly low image density (still acceptable) |
| Ex. 21 | Dispersion 4 | ◎ | Excellent |
| Ex. 22 | Dispersion 4 | ◎ | Good |
| Ex. 23 | Dispersion 4 | ◎ | Slight moiré fringes (still acceptable) |
| Ex. 24 | Dispersion 4 | ◎ | Extremely slight moiré fringes (still acceptable) |
| Ex. 25 | Dispersion 4 | ◎ | Good |

Example 26

The procedure for preparation of the photoreceptor in Example 3 was repeated except that the charge transport layer coating liquid was replaced with the following.

| | |
|---|---|
| Charge transport polymer having the following formula (weight average molecular weight of 135,000) | 10 parts |

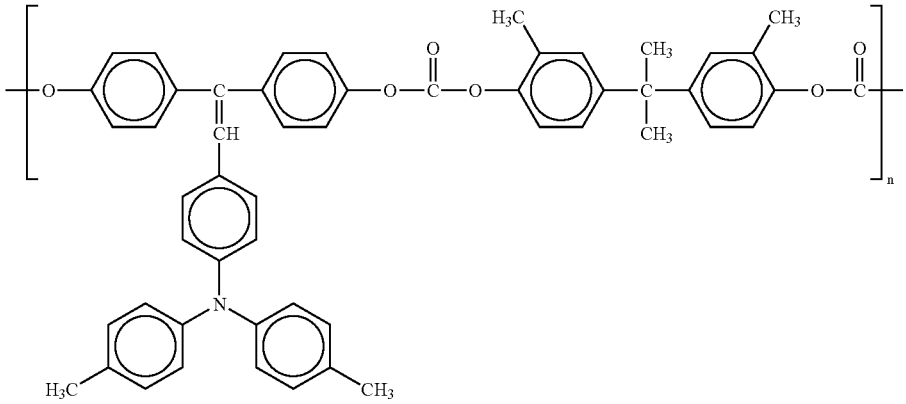

-continued

| | |
|---|---|
| Additive having the following formula | 0.5 parts |

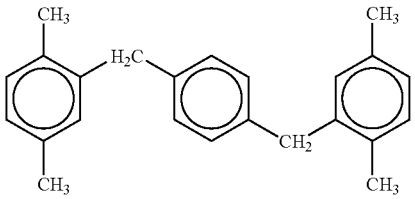

| | |
|---|---|
| Methylene chloride | 100 parts |

Example 27

The procedure for preparation of the photoreceptor in Example 3 was repeated except that the thickness of the charge transport layer was changed to 18 μm, and the following protective layer coating liquid was coated on the charge transport layer, followed by drying to prepare a protective layer having a thickness of 5 μm.

| Protective layer coating liquid | |
|---|---|
| Polycarbonate (TS2050 from Teijin Chemical Ltd., viscosity average molecular weight of 50,000) | 10 parts |
| Charge transport material having the following formula | 7 parts |

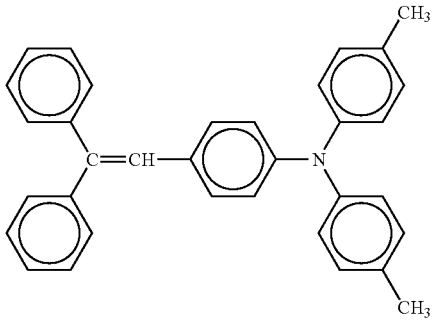

| | |
|---|---|
| Particulate alumina (resistivity of $2.5 \times 10^{12}$ Ω · cm, average primary particle diameter of 0.4 μm) | 4 parts |
| Cyclohexanone | 500 parts |
| Tetrahydrofuran | 150 parts |

Example 28

The procedure for preparation of the photoreceptor in Example 27 was repeated except that the particulate alumina in the protective layer coating liquid was replaced with the following titanium oxide.

| | |
|---|---|
| Titanium oxide (resistivity of $1.5 \times 10^{10}$ Ω · cm, average primary particle diameter of 0.5 μm) | 4 parts |

Example 29

The procedure for preparation of the photoreceptor in Example 27 was repeated except that the particulate alumina in the protective layer coating liquid was replaced with the following tin oxide-antimony oxide powder.

| | |
|---|---|
| Tin oxide —antimony oxide powder (resistivity of $1 \times 10^{6}$ Ω · cm, average primary particle diameter of 0.4 μm) | 4 parts |

Example 30

The procedure for preparation of the photoreceptor in Example 3 was repeated except that the thickness of the charge transport layer was changed to 18 μm, and the following protective layer coating liquid was coated on the charge transport layer, followed by drying to prepare a protective layer having a thickness of 5 μm.

| Protective layer coating liquid | |
|---|---|
| Methyltrimethoxy silane | 100 parts |
| 3% acetic acid | 20 parts |
| Charge transport material having the following formula | 35 parts |

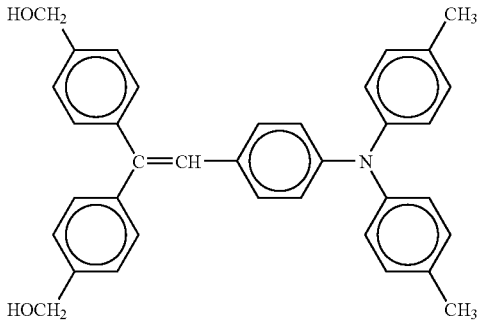

| | |
|---|---|
| Antioxidant (SANOL LS2626 from Sankyo Chemical Co., Ltd.) | 1 part |
| Crosslinking agent (dibutyl tin acetate) | 1 part |
| 2-propanol | 200 parts |

Example 31

The procedure for preparation of the photoreceptor in Example 3 was repeated except that the thickness of the charge transport layer was changed to 18 μm, and the following protective layer coating liquid was coated on the charge transport layer, followed by drying to prepare a protective layer having a thickness of 5 μm.

| Protective layer coating liquid | |
|---|---|
| Methyltrimethoxy silane | 100 parts |
| 3% acetic acid | 20 parts |
| Charge transport material having the following formula | 35 parts |
| Particulate α-alumina (SUMICORUNDUM AA-03 from Sumitomo Chemical Co., Ltd.) | 15 parts |
| Antioxidant (SANOL LS2626 from Sankyo Chemical Co., Ltd.) | 1 part |
| Polycarboxylic acid (BYK P104 from Byk Chemie) | 0.4 parts |
| Crosslinking agent (dibutyl tin acetate) | 1 part |
| 2-propanol | 200 parts |

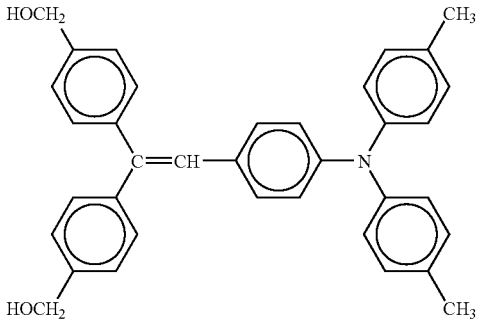

Evaluation (Evaluation Method 2)

Each of the thus prepared photoreceptors of Examples 26-31 and the photoreceptor of Example 3 was set in an image forming apparatus having a constitution as illustrated in FIG. 9. The image forming apparatus includes a laser diode which emits light having a wavelength of 655 nm and which serves as the light irradiating device; a polygon mirror configured to scan the light for optical writing; and a short-range charging roller which has a constitution as illustrated in FIG. 10 and which is prepared by winding an insulating tape with a thickness of 50 μm on both side portions of a charging roller (i.e., the gap between the surface of the photoreceptor and surface of the charging roller is 50 μm). A running test in which 200,000 images of an original with an image area proportion of 6% are continuously reproduced was performed on each photoreceptor using a A-4 size plain paper, followed by production of white solid images and half tone images. The image forming conditions are as follows.

(1) environmental conditions: 22° C. and 55% RH (2) charging conditions:

DC bias: −900 V

AC bias: 2.0 kV (peak to peak voltage)

2.0 kHz (frequency)

The image qualities of the white solid images and half tone images, i.e., background development, moiré fringes and image density, were checked and the background development was graded into the following four ranks:

◎: excellent

○: good

Δ: slightly bad

X: bad

In addition, the abrasion loss of the surface of each photoreceptor was measured after the running test.

The results are shown in Table 3.

TABLE 3

| | | Image qualities | | Abrasion |
|---|---|---|---|---|
| Photo-receptor | Dispersion used | Background development | Half tone image quality | loss (μm) |
| Ex. 1 | Dispersion 4 | ◎-○ | Good | 5.9 |
| Ex. 26 | Dispersion 4 | ◎ | Good | 3.7 |
| Ex. 27 | Dispersion 4 | ◎ | Good | 2.5 |
| Ex. 28 | Dispersion 4 | ◎ | Good | 2.3 |
| Ex. 29 | Dispersion 4 | ○ | Slightly blurred (still acceptable) | 2.5 |
| Ex. 30 | Dispersion 4 | ◎ | Good | 1.9 |
| Ex. 31 | Dispersion 4 | ◎ | Good | 1.3 |

Example 32

The photoreceptor of Example 3 was evaluated by the evaluation method 2 except that after the 200,000-sheet running test, half tone images were also produced under environmental conditions of 30° C. and 90% RH to be evaluated.

Example 33

The procedure for evaluation of the photoreceptor in Example 32 was repeated except that the short-range charger used for the image forming apparatus was replaced with a scorotron charger while the potential of the image area of the photoreceptor was controlled so as to be −900 V.

Example 34

The procedure for evaluation of the photoreceptor in Example 32 was repeated except that the short-range charger used for the image forming apparatus was replaced with a contact charging roller (i.e., the gap is 0 μm).

Example 35

The procedure for evaluation of the photoreceptor in Example 34 was repeated except that the charging conditions were changed to the following.

DC bias: −1600 V (the potential of an image area is −900 V)

AC bias: 0

Example 36

The procedure for evaluation of the photoreceptor in Example 32 was repeated except that the charging conditions were changed to the following.

DC bias: −1600 V (the potential of image area is −900 V)

AC bias: 0

Example 37

The procedure for evaluation of the photoreceptor in Example 32 was repeated except that the gap between the surface of the short-range charger and the surface of the photoreceptor was changed to 70 μm.

Example 38

The procedure for evaluation of the photoreceptor in Example 32 was repeated except that the gap between the surface of the short-range charger and the surface of the photoreceptor was changed to 100 μm.

Example 39

The procedure for evaluation of the photoreceptor in Example 32 was repeated except that the gap between the surface of the short-range charger and the surface of the photoreceptor was changed to 150 μm.

Example 40

The photoreceptor of Example 26 was evaluated by the evaluation method 2 except that after the 200,000-sheet running test, half tone images were also produced under environmental conditions of 30° C. and 90% RH to be evaluated.

Example 41

The photoreceptor of Example 27 was evaluated by the evaluation method 2 except that after the 200,000-sheet running test, half tone images were also produced under environmental conditions of 30° C. and 90% RH to be evaluated.

The evaluation results are shown in Table 4.

TABLE 4

| | Image qualities (22° C./55% RH) | | Half tone image | |
|---|---|---|---|---|
| | Background development | Half tone image | (30° C./ 90% RH) | Note |
| Ex. 32 | ○ | Good | Good | |
| Ex. 33 | ○ | Extremely slightly blurred | Slightly blurred | There was strong smell of ozone during the running test |
| Ex. 34 | ○ | Extremely slightly uneven image density | Extremely slightly uneven image density | The charging roller was soiled. |
| Ex. 35 | ○ | Slightly uneven image density | Slightly uneven image density | The charging roller was soiled. |
| Ex. 36 | ○ | Slightly uneven image density | Slightly uneven image density | |
| Ex. 37 | ○ | Good | Good | |
| Ex. 38 | ○ | Good | Good | |
| Ex. 39 | ○ | Slightly uneven image density | Slightly uneven image density | |
| Ex. 40 | ◎ | Good | Good | |
| Ex. 41 | ◎ | Good | Good | |

The abnormal images (i.e., blurred images, and uneven density images) formed in Examples 33-36 and 39 were on an acceptable level.

Example 42

The procedure for preparation of the photoreceptor in Example 1 was repeated except that the aluminum cylinder serving as the substrate of the photoreceptor was replaced with an aluminum cylinder having a diameter of 30 mm.

Example 43

The procedure for preparation of the photoreceptor in Example 2 was repeated except that the aluminum cylinder serving as the substrate of the photoreceptor was replaced with an aluminum cylinder having a diameter of 30 mm.

Comparative Example 5

The procedure for preparation of the photoreceptor in Comparative Example 1 was repeated except that the aluminum cylinder serving as the substrate of the photoreceptor was replaced with an aluminum cylinder having a diameter of 30 mm.

Example 44

The procedure for preparation of the photoreceptor in Example 3 was repeated except that the aluminum cylinder serving as the substrate of the photoreceptor was replaced with an aluminum cylinder having a diameter of 30 mm.

Comparative Example 6

The procedure for preparation of the photoreceptor in Comparative Example 2 was repeated except that the aluminum cylinder serving as the substrate of the photoreceptor was replaced with an aluminum cylinder having a diameter of 30 mm.

Comparative Example 7

The procedure for preparation of the photoreceptor in Comparative Example 3 was repeated except that the aluminum cylinder serving as the substrate of the photoreceptor was replaced with an aluminum cylinder having a diameter of 30 mm.

Comparative Example 8

The procedure for preparation of the photoreceptor in Comparative Example 4 was repeated except that the aluminum cylinder serving as the substrate of the photoreceptor was replaced with an aluminum cylinder having a diameter of 30 mm.

Evaluation (Evaluation Method 3)

Each of the photoreceptors of Examples 42-44 and Comparative Examples 5-8 was set in each of four process cartridges together with a charger, and the four process cartridges were set in a full color image forming apparatus having the constitution as illustrated in FIG. 13. Then a running test in which 200,000 images of a full color original image are continuously produced was performed under conditions of 22° C. and 55% RH. The charging conditions are as follows.

DC bias: −800 V

AC bias: 1.8 kV (peak to peak voltage)
2.0 kHz (frequency)

Charger: The short-range charger which is the same as that used in the evaluation method 2.

Optical writing: laser diode emitting light with wavelength of 655 nm and polygon mirror Transfer bias: (1) 75 μA and (2) 60 μA (current)

After the running test, the color image was observed to determine whether the resultant image has background development and omissions and to evaluate the half tone image qualities.

The image qualities, i.e., background development and omissions, were graded into the following four ranks:

Δ: excellent

Δ: good

Δ: slightly bad

X: bad

The results are shown in Table 5.

TABLE 5

| Photoreceptor | Dispersion used | Image qualities: Background development | Image qualities: Half tone image quality |
|---|---|---|---|
| Ex. 42 | Dispersion 1 | ○-Δ | Slightly low image (still acceptable) |
| Ex. 43 | Dispersion 2 | ○ | Good |
| Comp. Ex. 5 | Dispersion 3 | ○-Δ | Color reproducibility deteriorates. Low image density. |
| Ex. 44 | Dispersion 4 | ◎-○ | Good |
| Comp. Ex. 6 | Dispersion 4 | X | Background development |
| Comp. Ex. 7 | Dispersion 4 | ○ | Moire fringe |
| Comp. Ex. 8 | Dispersion 4 | ○ | Low image density |

This document claims priority and contains subject matter related to Japanese Patent Application No. 2004-201300, filed on Jul. 8, 2004, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A photoreceptor comprising at least an electroconductive substrate, and a charge blocking layer, a moiré preventing layer, and a photosensitive layer, which are located overlying the electroconductive substrate in this order, wherein the photosensitive layer comprises an azo pigment having the following formula (I):

(I)

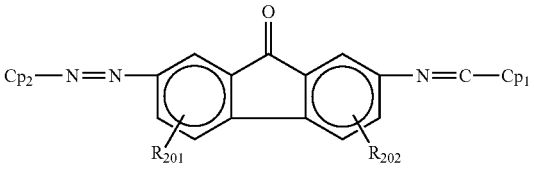

wherein $R_{201}$ and $R_{202}$ independently represent a hydrogen atom, a halogen atom, an alkyl group, an alkoxyl group, or a cyano group; and $Cp_1$ and $Cp_2$ independently represent a residual group of a coupler, which has the following formula (II):

(II)

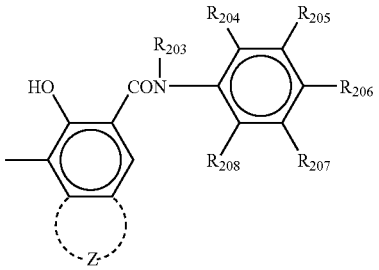

wherein $R_{203}$ represents a hydrogen atom, an alkyl group, or an aryl group; $R_{204}$, $R_{205}$, $R_{206}$, $R_{207}$ and $R_{208}$ independently represent a hydrogen atom, a nitro group, a cyano group, a halogen atom, an alkyl group, an alkoxyl group, a dialkylamino group or a hydroxyl group; and Z represents an atomic group needed for constituting a substituted or unsubstituted aromatic carbon ring or a substituted or unsubstituted aromatic heterocyclic ring, and wherein the photosensitive layer is prepared by coating a coating liquid including a dispersion which is prepared by dispersing the azo pigment in a solvent to an extent such that an average particle diameter of the azo pigment is not greater than 0.3 μm and a standard deviation of the particle diameter is not greater than 0.2 μm, followed by filtering with a filter having an effective pore diameter not greater than 5 μm and which includes only particles of the azo pigment having particle diameters not greater than 0.25 μm.

2. The photoreceptor according to claim 1, wherein the group Cp1 is different from the group Cp2.

3. The photoreceptor according to claim 1, wherein the photosensitive layer comprises a charge generation layer and a charge transport layer.

4. The photoreceptor according to claim 1, wherein the charge blocking layer comprises an insulating material and has a thickness not greater than 2.0 μm.

5. The photoreceptor according to claim 4, wherein the insulating material comprises a polyamide resin.

6. The photoreceptor according to claim 1, wherein the moiré preventing layer comprises an inorganic pigment and a binder resin, wherein a volume ratio of the inorganic pigment to the binder resin is from 1/1 to 3/1.

7. The photoreceptor according to claim 6, wherein the binder resin comprises a thermosetting resin.

8. The photoreceptor according to claim 7, wherein the thermosetting resin comprises an alkyd resin and a melamine resin.

9. The photoreceptor according to claim 8, wherein a weight ratio of the alkyd resin to the melamine resin is from 5/5 to 8/2.

10. The photoreceptor according to claim 6, wherein the inorganic pigment comprises titanium oxide.

11. The photoreceptor according to claim 10, wherein the inorganic pigments includes two kinds of titanium oxides, T1 and T2, wherein the two kinds of titanium oxides satisfy the following relationship:

$$0.2 < (D2/D1) \leqq 0.5$$

wherein D1 and D2 represents the average particle diameters of the two kinds of titanium oxides T1 and T2, respectively.

12. The photoreceptor according to claim 11, wherein the average particle diameter (D2) of the titanium oxide (T2) is greater than 0.05 μm and less than 0.2 μm.

13. The photoreceptor according to claim 11, wherein a weight ratio (T2/(T1 +T2)) of the titanium oxide (T2) to total weight of the titanium oxides (T1 +T2) is from 0.2 to 0.8.

14. The photoreceptor according to claim 1, further comprising a protective layer located overlying the photosensitive layer.

15. ) The photoreceptor according to claim 14, wherein the protective layer comprises an inorganic pigment having a resistivity not less than $10^{10}$ Ω·cm.

16. The photoreceptor according to claim 15, wherein the inorganic pigment comprises a pigment selected from the group consisting of alumina, titanium oxide and silica, which have a resistivity not less than $10^{10}$ Ω·cm.

17. The photoreceptor according to claim 16, wherein the inorganic pigment comprises α-alumina.

18. The photoreceptor according to claim 14, wherein the protective layer comprises a charge transport polymer.

19. The photoreceptor according to claim 14, wherein the protective layer comprises a crosslinked binder resin.

20. The photoreceptor according to claim 19, wherein the crosslinked binder resin comprises a charge transport moiety.

21. An image forming apparatus comprises one or more image forming units each comprising:

the photoreceptor according to claim 1;

a charging device configured to charge the photoreceptor;

a light irradiating device configured to irradiate the photoreceptor with imagewise light to form an electrostatic latent image on the photoreceptor;

a developing device configured to develop the electrostatic latent image with a developer comprising a toner to form a toner image on the photoreceptor; and a transferring device configured to transfer the toner image onto a receiving material.

22. The image forming apparatus according to claim 21, wherein the charging device comprises either a contact charger or a short-range charger.

23. The image forming apparatus according to claim 22, wherein the charging device includes a short-range charger charges the photoreceptor with a gap not greater than 100 μm.

24. The image forming apparatus according to claim 21, wherein the charging device applies a DC voltage overlapped with an AC voltage to the photoreceptor.

25. The image forming apparatus according to claim 21, further comprising a cleaning device configured to clean a surface of the photoreceptor, wherein the photoreceptor and at least one of the charging device, the light irradiating device, the developing device and the cleaning device are unitized as a process cartridge, and wherein the process cartridge is detachably attached to the image forming apparatus.

26. A process cartridge comprising:

the photoreceptor according to claim 1; and at least one of:

a charging device configured to charge the photoreceptor;

a light irradiating device configured to irradiate the photoreceptor with imagewise light to form an electrostatic latent image on the photoreceptor;

a developing device configured to develop the electrostatic latent image with a developer comprising a toner to form a toner image on the photoreceptor; and a cleaning device configured to clean a surface of the photoreceptor.

* * * * *